US009857048B2

(12) United States Patent
Workman et al.

(10) Patent No.: US 9,857,048 B2
(45) Date of Patent: Jan. 2, 2018

(54) PORTABLE LIGHTING DEVICE

(71) Applicant: Goal Zero LLC, Bluffdale, UT (US)

(72) Inventors: Robert E. Workman, Morgan, UT (US); Norman L. Krantz, Draper, UT (US); Jaremy T. Butler, Herriman, UT (US); Fred K. Lillywhite, Cottonwood Heights, UT (US)

(73) Assignee: Goal Zero LLC, Bluffdale, UT (US)

( * ) Notice: Subject to any disclaimer, the term of this patent is extended or adjusted under 35 U.S.C. 154(b) by 179 days.

(21) Appl. No.: 14/987,332

(22) Filed: Jan. 4, 2016

(65) Prior Publication Data

US 2016/0195235 A1 Jul. 7, 2016

Related U.S. Application Data

(60) Provisional application No. 62/099,905, filed on Jan. 5, 2015.

(51) Int. Cl.

| | |
|---|---|
| ***F21V 1/08*** | (2006.01) |
| ***F21V 1/06*** | (2006.01) |
| ***F21V 23/00*** | (2015.01) |
| ***F21V 17/00*** | (2006.01) |
| *F21V 15/00* | (2015.01) |
| *F21V 21/08* | (2006.01) |
| *F21Y 115/10* | (2016.01) |

(52) U.S. Cl.

CPC ..... *F21V 1/08* (2013.01); *F21V 17/007* (2013.01); *F21V 15/00* (2013.01); *F21V 21/08* (2013.01); *F21V 23/001* (2013.01); *F21Y 2115/10* (2016.08)

(58) Field of Classification Search

CPC . F21V 1/08; F21V 1/06; F21V 17/007; F21V 15/00; F21V 23/001

See application file for complete search history.

(56) References Cited

U.S. PATENT DOCUMENTS

| | | | | |
|---|---|---|---|---|
| 8,434,894 | B2 | 5/2013 | Workman et al. | |
| 8,562,158 | B2 * | 10/2013 | Chien | F21V 19/00 362/276 |
| 8,711,216 | B2 * | 4/2014 | Chien | F21S 8/035 348/142 |
| 8,760,514 | B2 * | 6/2014 | Chien | F21S 8/035 348/143 |
| 8,967,831 | B2 * | 3/2015 | Chien | F21V 3/02 362/234 |

OTHER PUBLICATIONS

U.S. Appl. No. 61/261,656, filed Nov. 16, 2009, Workman et al.

* cited by examiner

*Primary Examiner* — Karabi Guharay
(74) *Attorney, Agent, or Firm* — Foley & Lardner LLP

(57) ABSTRACT

A lighting device includes a body portion, a collar having a first end coupled to the body portion, a plate coupled to a second end of the collar, a light source disposed at the second end of the collar, and a shade including a sidewall and a cap defining a plurality of interfaces. The plurality of interfaces and the plate cooperate to releasably secure the shade in a storage orientation and an extended orientation. The light source includes one or more LEDs.

20 Claims, 20 Drawing Sheets

PORTABLE LIGHTING DEVICE

CROSS-REFERENCE TO RELATED PATENT APPLICATIONS

This application claims the benefit of U.S. Provisional Patent Application No. 62/099,905, filed Jan. 5, 2015, which is incorporated herein by reference in its entirety.

BACKGROUND

The present application relates to a lighting device. Particularly, the present application relates to a portable lighting device.

Lighting devices traditionally include one or more light bulbs, which may be LED light bulbs or incandescent light bulbs. The one or more light bulbs are traditionally turned on and off to provide a single "on" light profile in addition to an "off" configuration. Such an "on" light profile may produce an excessive light output relative to the user's particular needs. Strings of such lighting devices are traditionally turned on and off together (e.g., by plugging the string in or unplugging the string, etc.). Surrounding areas devoid of users may thereby also be unnecessarily illuminated. The lighting devices may include shades disposed over the one or more light bulbs. The shades are fixed to body portions of the lighting devices, thereby protecting the one or more light bulbs (e.g., during use, during transport, etc.). Such lighting devices may be difficult to pack and transport due to the size and shape of the shades.

SUMMARY

One exemplary embodiment relates to a lighting device. The lighting device includes a body portion, a collar having a first end coupled to the body portion, a plate coupled to a second end of the collar, a light source disposed at the second end of the collar, and a shade including a sidewall and a cap defining a plurality of interfaces. The plurality of interfaces and the plate cooperate to releasably secure the shade in a storage orientation and an extended orientation. The light source includes one or more LEDs.

Another exemplary embodiment relates to a lighting device. The lighting device includes a body portion, a plate coupled to the body portion, a collar disposed between the body portion and the plate, a light source extending through at least a portion of the plate, and a cover including a sidewall and a cap. The plate has a plurality of interface members extending therefrom. The light source is configured to provide a light output. The cap defines a plurality of interfaces and an aperture shaped to receive the plurality of interface members of the plate. The plurality of interfaces and the plurality of interface members cooperate to releasably secure the cover to the plate in a storage orientation and an extended orientation. The cover at least partially encloses the light source when arranged in the extended orientation such that the sidewall of the cover diffuses at least a portion of the light output of the light source.

Still another exemplary embodiment relates to a portable lighting device. The portable lighting device includes a body, a collar having a peripheral wall, a plate, a cable, and a shade. A first end of the peripheral wall of the collar is coupled to the body. A second end of the peripheral wall of the collar is coupled to the plate. The light source is configured to provide a light output. The cable is configured to provide an electrical input to power the light source. The shade is configured to at least partially enclose the peripheral wall of the collar and an underside of the body such that an internal space is defined by at least the underside of the body, the peripheral wall of the collar, and an inner surface of the shade. At least a portion of the cable is selectively wrappable around at least one of the body and the peripheral wall of the collar such that the cable is storable within the internal space.

The invention is capable of other embodiments and of being carried out in various ways. Alternative exemplary embodiments relate to other features and combinations of features as may be generally recited in the claims.

BRIEF DESCRIPTION OF THE DRAWINGS

The disclosure will become more fully understood from the following detailed description taken in conjunction with the accompanying drawings wherein like reference numerals refer to like elements, in which.

DETAILED DESCRIPTION

Before turning to the figures, which illustrate the exemplary embodiments in detail, it should be understood that the application may be not limited to the details or methodology set forth in the description or illustrated in the figures. It should also be understood that the terminology may be for the purpose of description only, and should not be regarded as limiting.

According to an exemplary embodiment, a portable lighting device is selectively reconfigurable between a plurality of orientations. While this and other discussions herein refer to the portable lighting device being selectively reconfigurable between a plurality of orientations, it should be understood that one or more components of the portable lighting device may be selectively reconfigured between various orientations. Reconfiguring the one or more components between the various orientations may thereby selectively reconfigure the portable lighting device between the various orientations discussed herein. The portable lighting device includes a lighting source (e.g., one or more LEDs, etc.) that provides a light output (e.g., to illuminate a surrounding environment, etc.) using an electrical input. In some embodiments, the portable lighting device is selectively reconfigurable between an extended orientation and a storage orientation. In the storage orientation, the overall size of the portable lighting device is reduced. Such a reduction in size may provide a more compact device. The storage orientation may thereby facilitate storing, packing, and transporting the portable lighting device.

The portable lighting device provides illumination in both the extended orientation and the storage orientation, according to an exemplary embodiment. By way of example, the portable lighting device may provide diffused lighting when configured in the extended orientation and flood lighting when configured in the storage orientation. The term "storage orientation" may thereby refer to a configuration of the portable lighting device without regard for the potential for operating a lighting source thereof.

Figure 1:
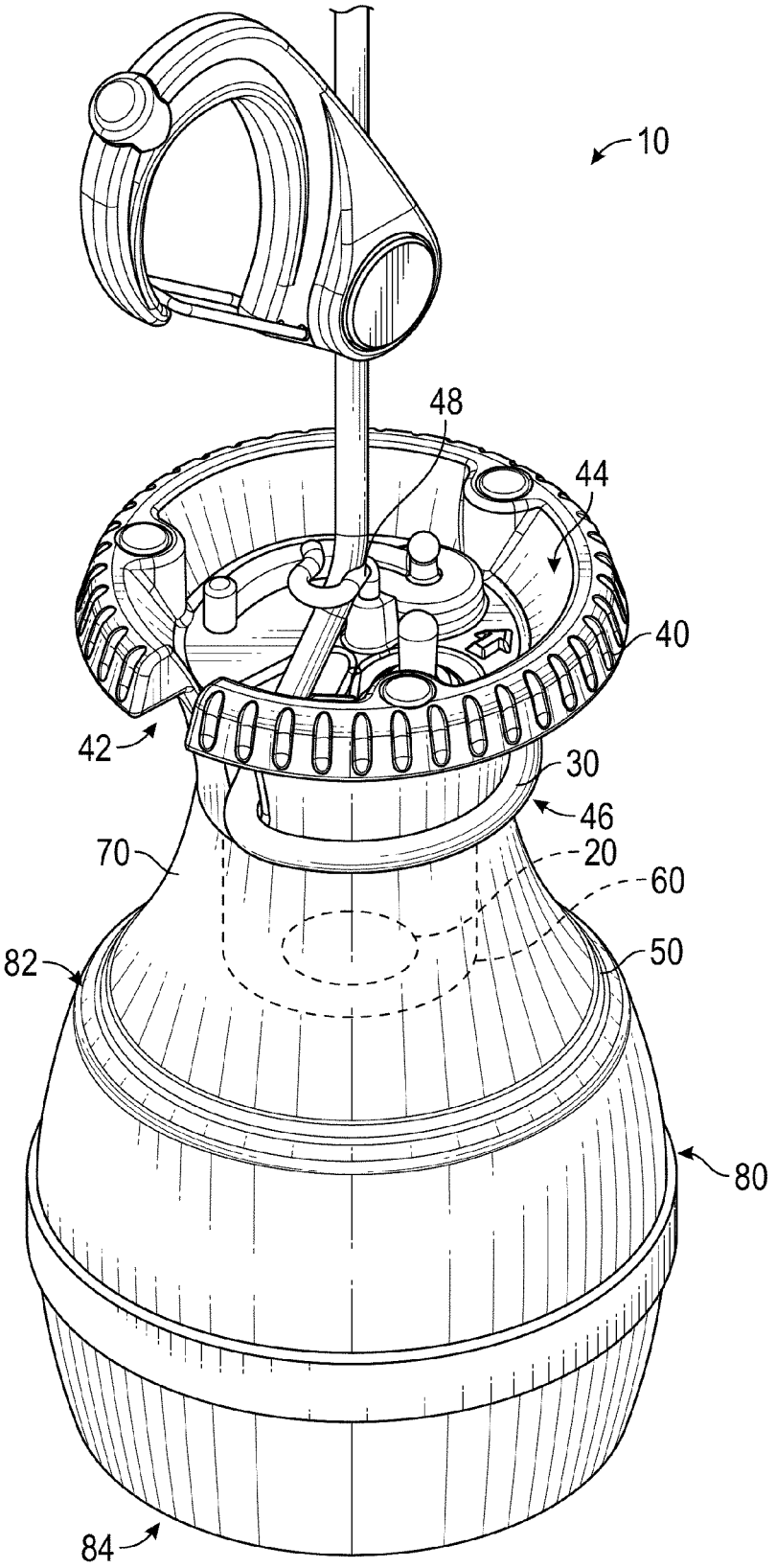
FIG. 1 is a front perspective view of a lighting device having a shade in an extended orientation, according to an exemplary embodiment.
Figure 2:
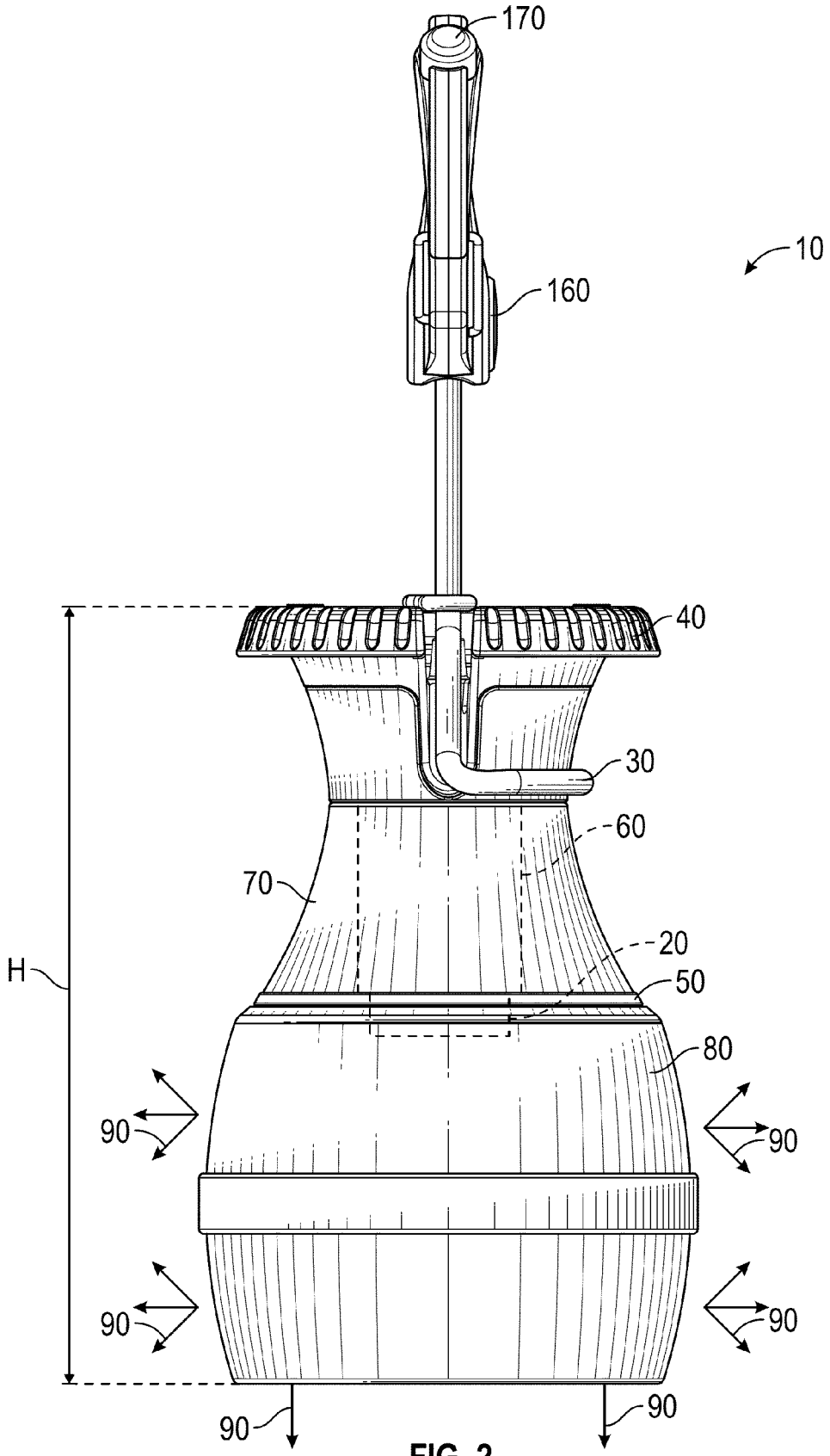
FIG. 2 is a front plan view of the lighting device of FIG. 1.
Figure 3:
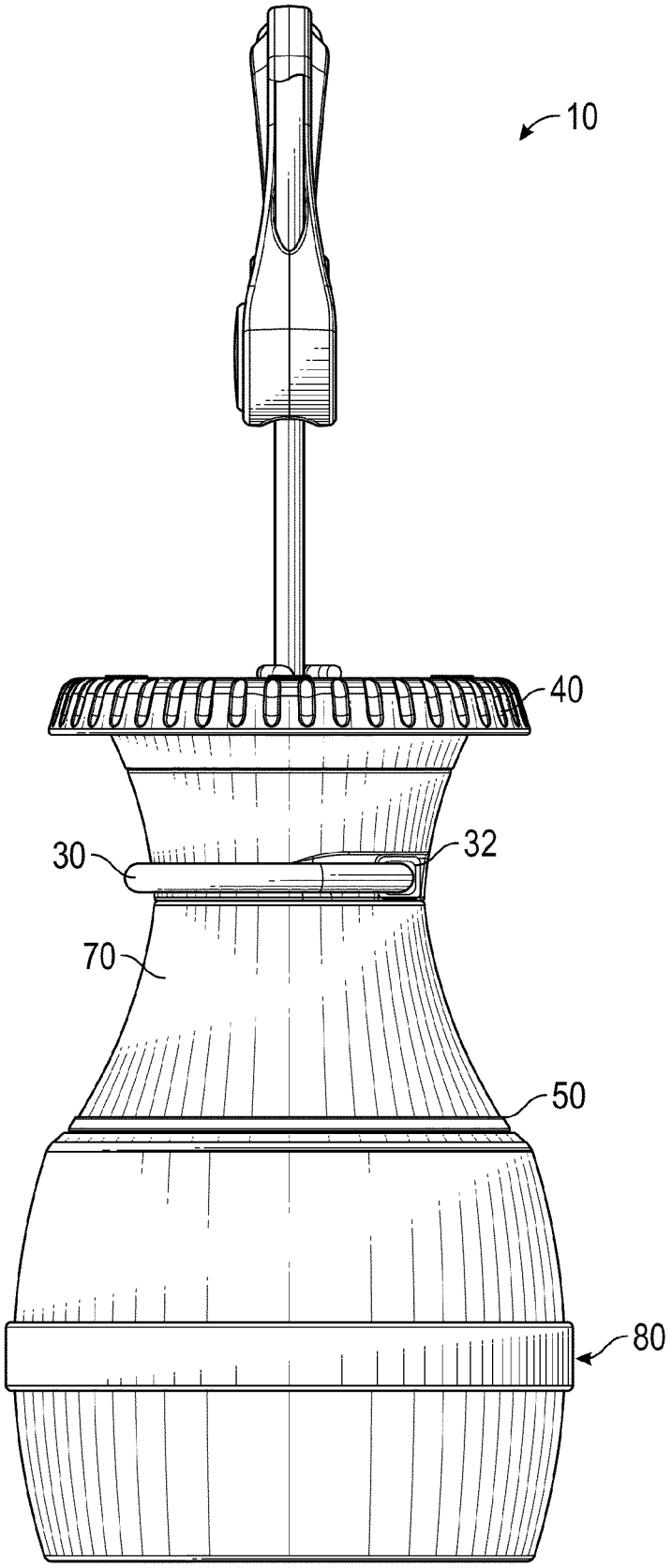
FIG. 3 is a rear plan view of the lighting device of FIG. 1.
Figure 4:
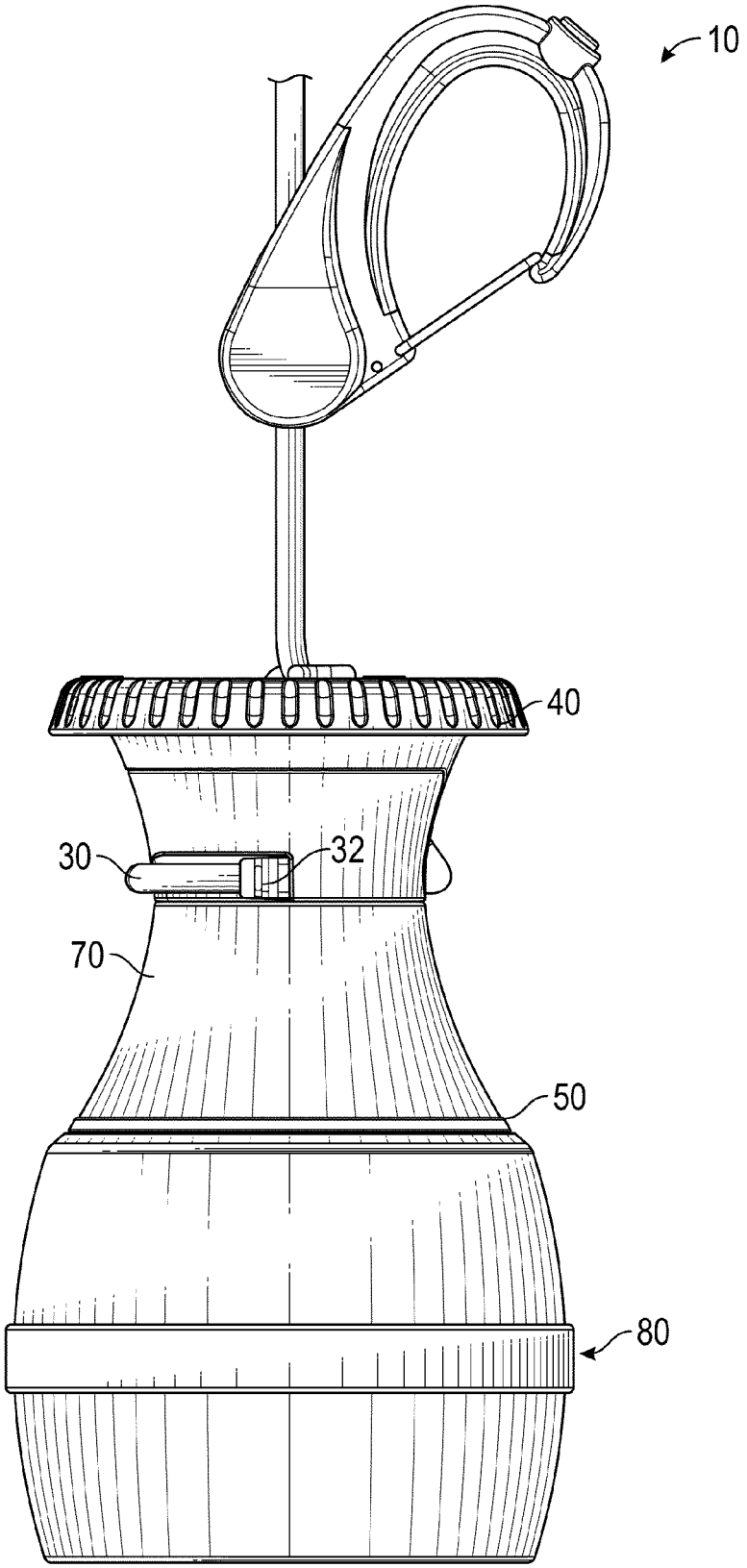
FIG. 4 is a right side plan view of the lighting device of FIG. 1.
Figure 5:
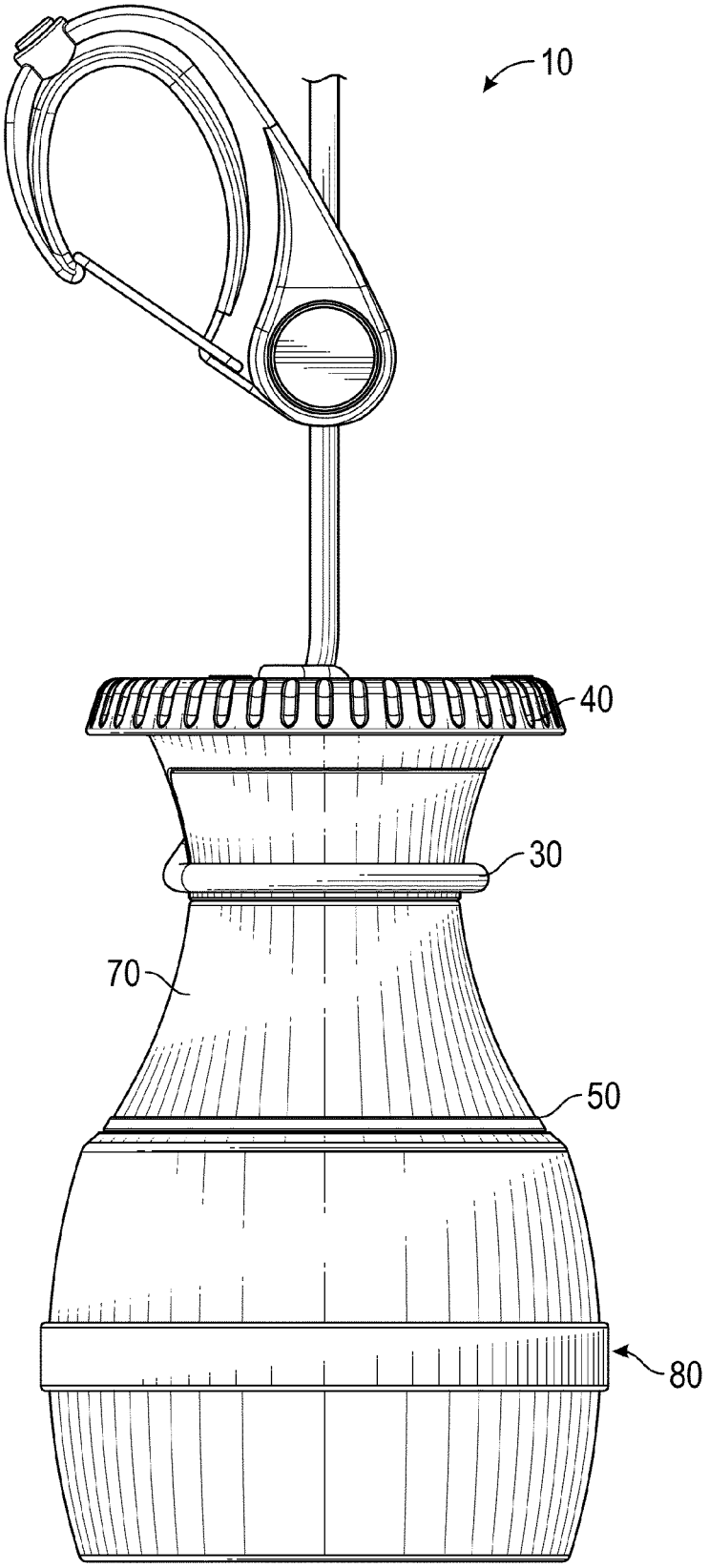
FIG. 5 is a left side plan view of the lighting device of FIG. 1.

According to the exemplary embodiment shown in FIGS. 1-26, a portable lighting device, shown as lantern 10, provides a light output and is selectively reconfigurable between a plurality of orientations. As shown in FIGS. 1-2, lantern 10 includes a lighting source 20. In one embodiment, lighting source 20 includes one or more LEDs. Lighting source 20 is configured to provide the light output using an electrical input. According to the exemplary embodiment shown in FIGS. 1-7, lantern 10 includes a cable, shown as power cable 30. An electrical input is provided to power cable 30 to power lantern 10, according to an exemplary embodiment. Power cable 30 is coupled to lighting source 20 and carries an electrical input thereto, according to an exemplary embodiment. As shown in FIG. 3, power cable 30 has an end 32 that is hardwired into the electrical components of lantern 10 such that power cable 30 defines an electrical input of lantern 10. In other embodiments, end 32 of power cable 30 is releasably coupled to an electrical input (e.g., male connector, female connector, etc.) of lantern 10. An opposing second end of power cable 30 may be configured to be coupled to a source of electrical power. By way of example, the source of electrical power may include a wall outlet, a portable energy storage and power supply device, or still another supply.

As shown in FIGS. 1-7, lantern 10 includes a body, shown as crown 40. In one embodiment, crown 40 is coupled to a plate, shown as plate 50. As shown in FIGS. 1-2, crown 40 is coupled to plate 50 with an internal structure 60. In one embodiment, internal structure 60 includes one or more blocks. Internal structure 60 may be manufactured using aluminum, another metal, a polymeric material, or still another material.

Figure 10:
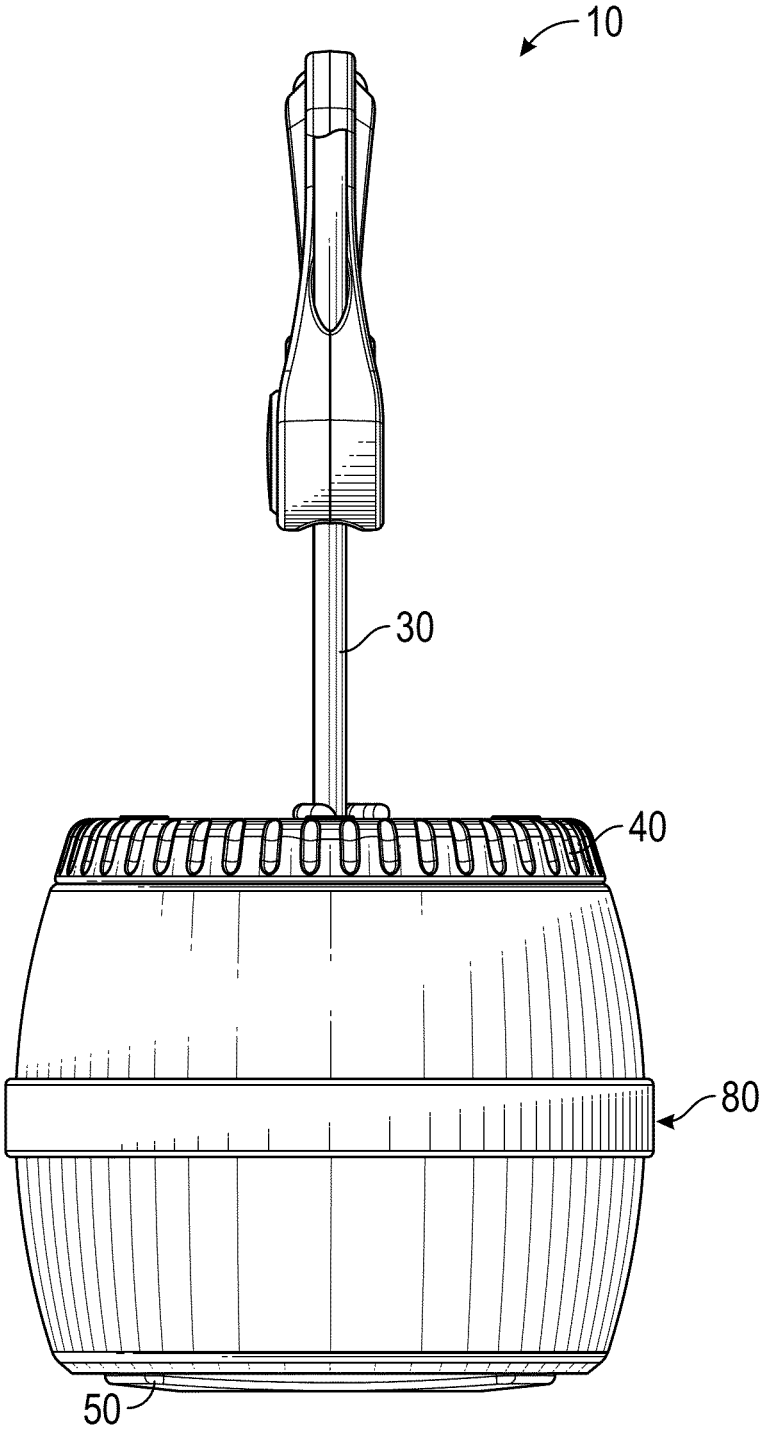
FIG. 10 is a rear plan view of the lighting device of FIG. 8.
Figure 11:
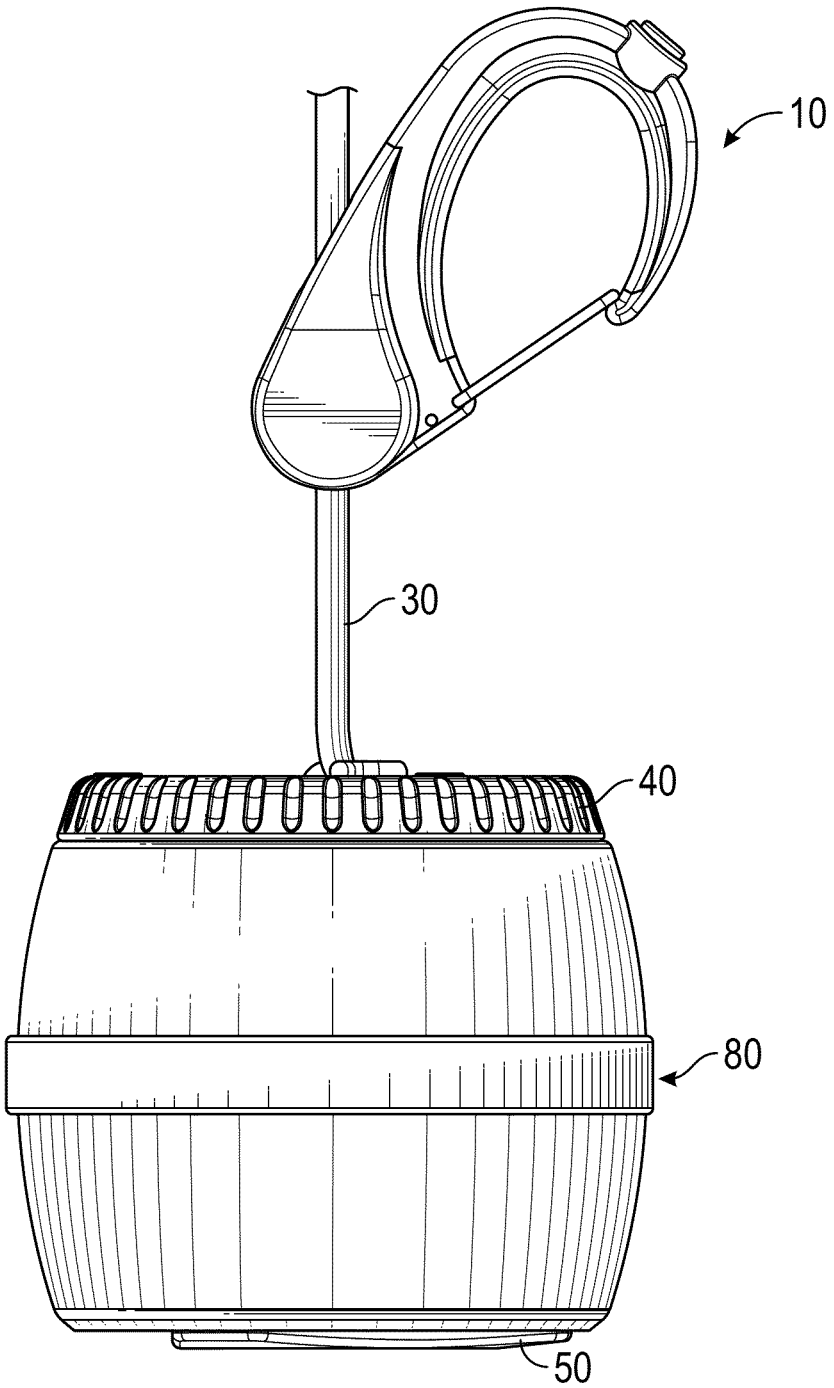
FIG. 11 is a right side plan view of the lighting device of FIG. 8.
Figure 12:
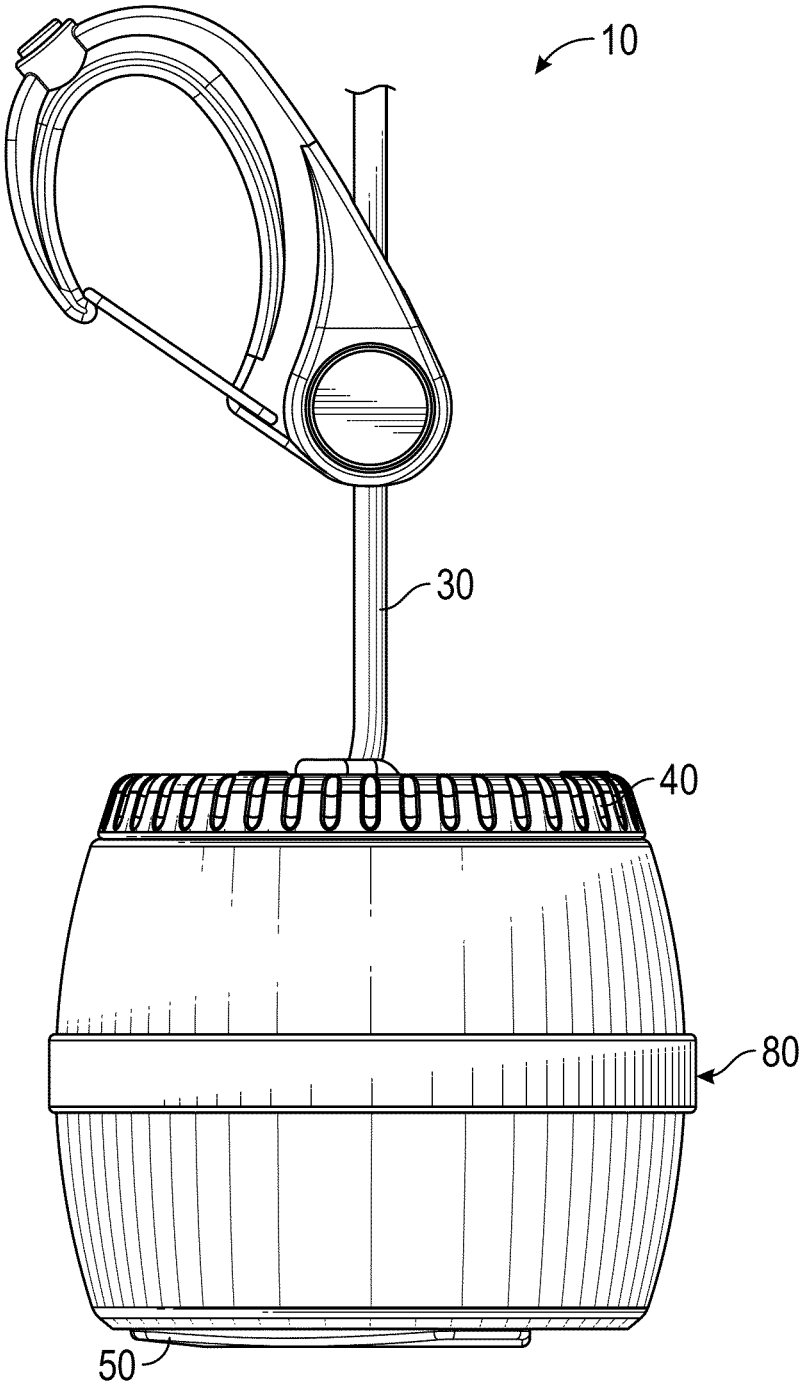
FIG. 12 is a left side plan view of the lighting device of FIG. 8.
Figure 13:
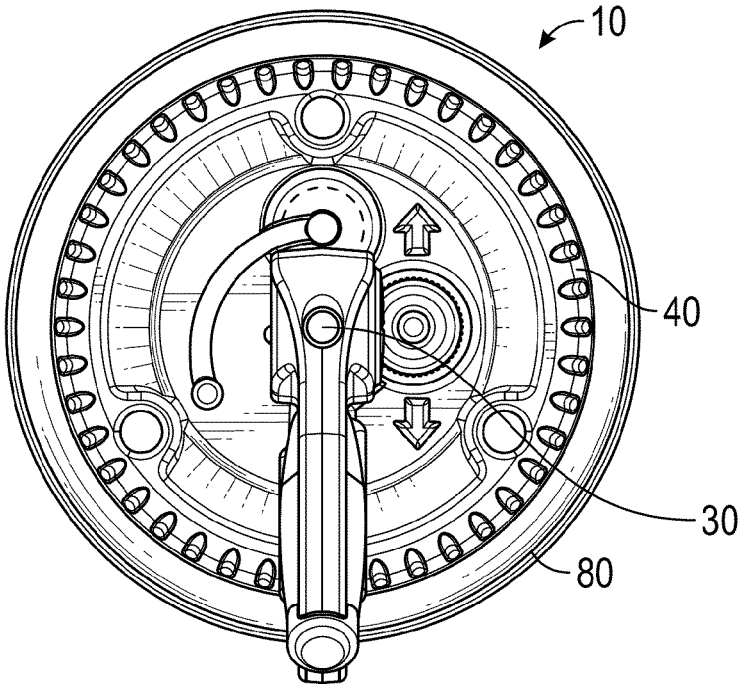
FIG. 13 is a top plan view of the lighting device of FIG. 8.
Figure 14:
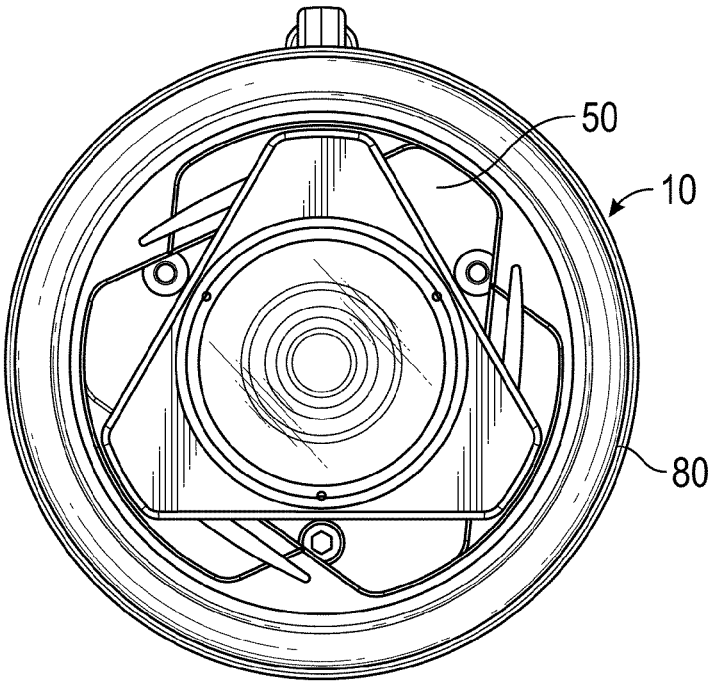
FIG. 14 is a bottom plan view of the lighting device of FIG. 8.
Figure 15:
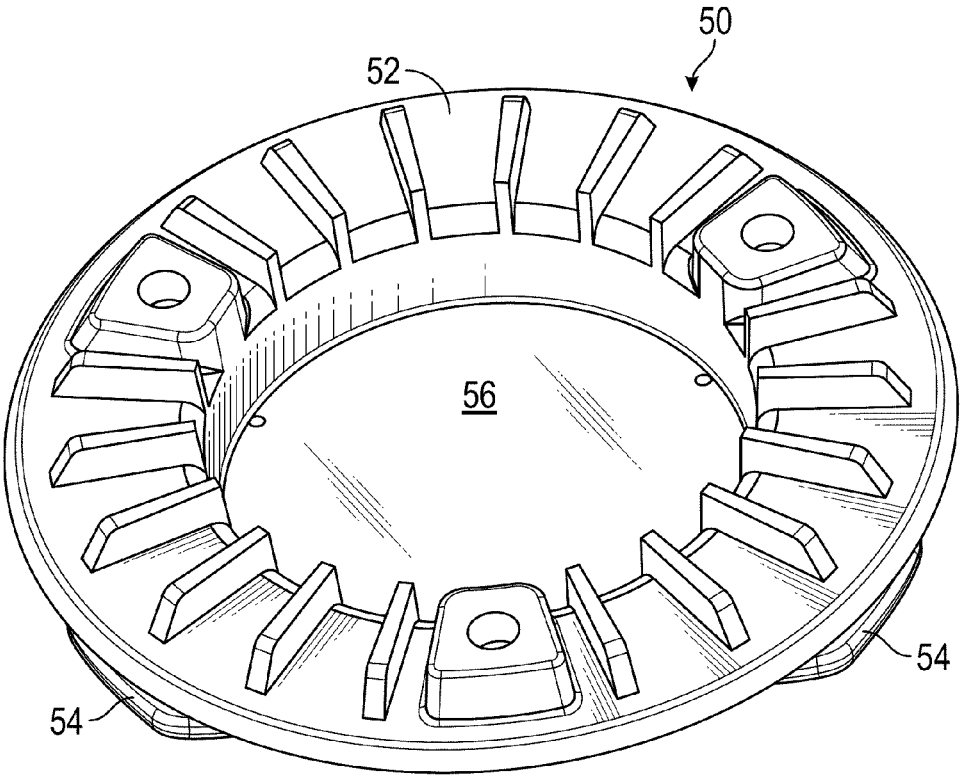
FIGS. 15-18 are perspective and plan views of a plate component of a lighting device, according to an exemplary embodiment.
Figure 16:
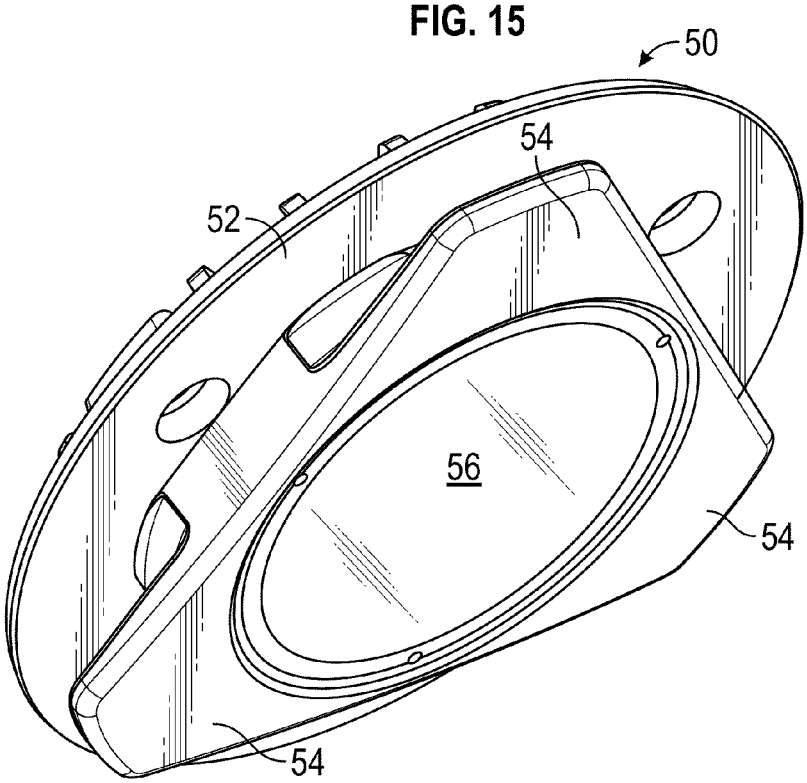
Figure 17:
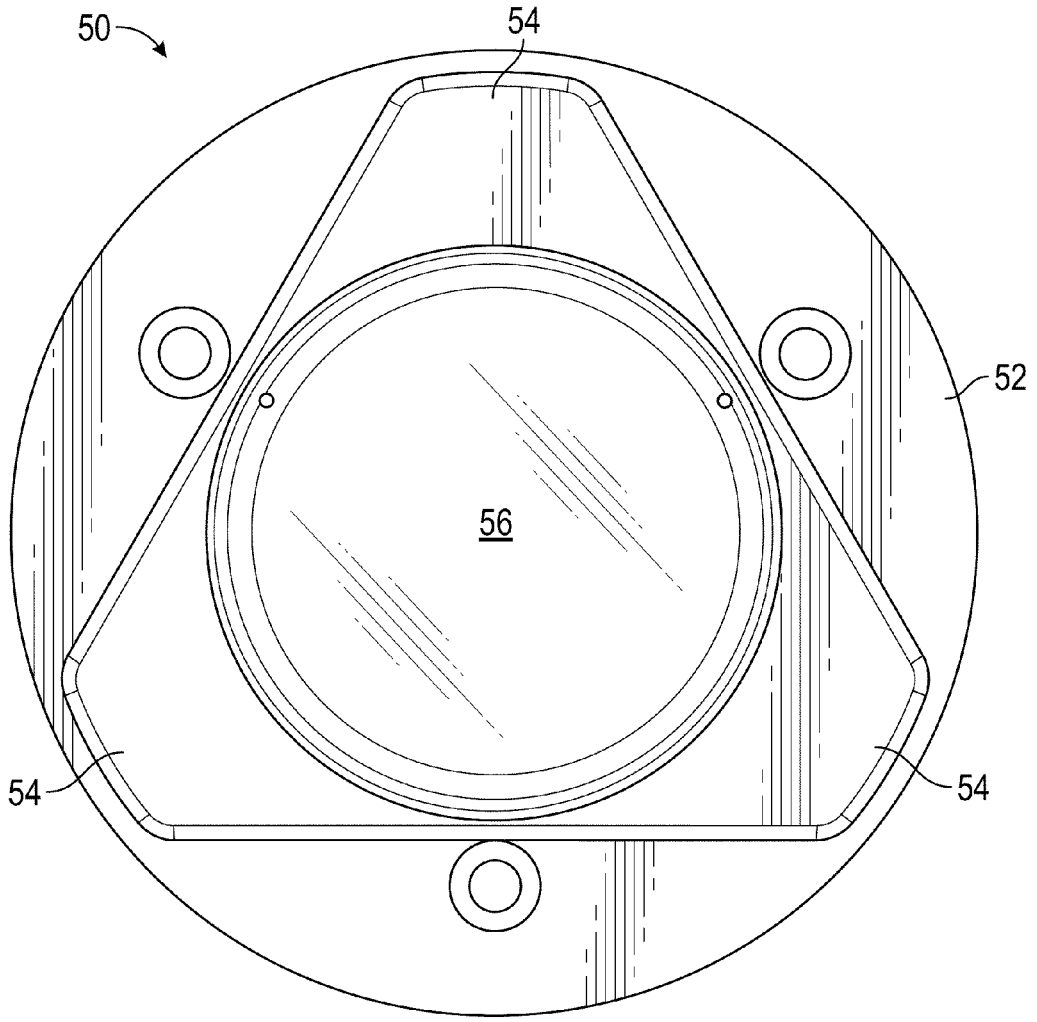
Figure 18:
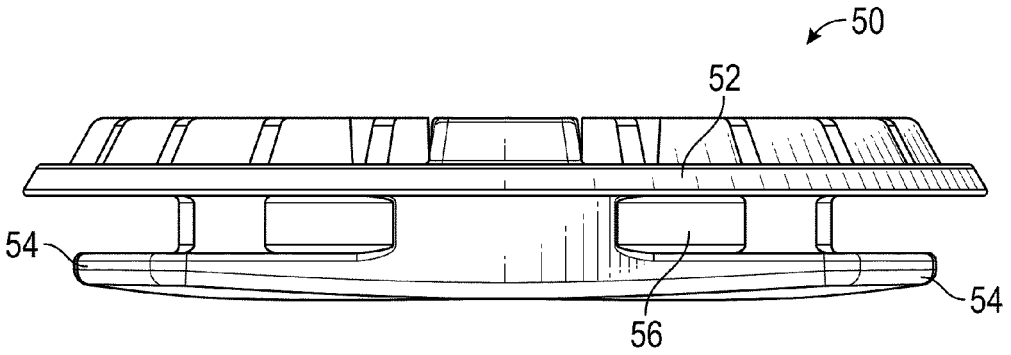

Referring still to FIGS. 1-7, lantern 10 includes a cover, shown as collar 70. As shown in FIG. 10, collar 70 extends between crown 40 and plate 50. In other embodiments, lantern 10 does not include collar 70. According to an exemplary embodiment, collar 70 defines an internal space within which internal structure 60 is disposed. Collar 70 may thereby surround internal structure 60, among other components of lantern 10. In one embodiment, collar 70 is manufactured from a metal (e.g., aluminum, etc.). In other embodiments, collar 70 is manufactured from a polymeric material or another material.

According to the exemplary embodiment shown in FIGS. 1-7, lantern 10 includes a shade (e.g., blind, curtain, screen, cover, lamp shade, etc.), shown as shade 80. Shade 80 is barrel-shaped, according to an exemplary embodiment. In one embodiment, shade 80 is generally cup-shaped and has an interface end 82 and an open end 84. Shade 80 is directly coupled to plate 50, according to the exemplary embodiment shown in FIGS. 1-7. By way of example, interface end 82 of shade 80 may be directly coupled to plate 50. In one embodiment, shade 80 is releasably coupled to plate 50. In other embodiments, shade 80 is directly coupled (e.g., releasably coupled, etc.) to another component of lantern 10 (e.g., collar 70, internal structure 60, etc.). Shade 80 may be manufactured from a polymeric material. In other embodiments, shade 80 is manufactured from another material (e.g., metal, glass, etc.).

A central volume of shade 80 may be manufactured from a diffusive material. In other embodiments, a diffusive material may be applied to one or more surfaces of shade 80 (e.g., an inner surface, an outer surface, an inner surface and an outer surface, etc.). In still other embodiments, one or more surfaces of shade 80 are etched, formed, or otherwise shaped to define a diffusive surface. Shade 80 may thereby be transparent, translucent, or opaque, according to various embodiments.

In one embodiment, shade 80 is coupled to plate 50 with a plurality of features that cooperate to define a twist-lock connection. According to an alternative embodiment, shade 80 is coupled to plate 50 with one or more magnets. According to still another alternative embodiment, shade 80 is coupled to plate 50 with one or more pieces of hook and loop fabric. In yet other embodiments, shade 80 is still otherwise releasably coupled to plate 50.

As shown in FIGS. 1-7, lantern 10 is configured in an extended orientation. A user may selectively reconfigure lantern 10 into the extended orientation to provide a gentle, diffuse light output to a surrounding area. The extended orientation of lantern 10 may be defined based on the orientation of shade 80 (i.e., lantern 10 may be configured in an extended orientation when shade 80 is configured in an extended orientation). According to the exemplary embodiment shown in FIGS. 1-7, shade 80 extends away from crown 40 and collar 70 when configured in the extended orientation. By way of example, shade 80 may extend along an axis that is orthogonal to a plane defined by plate 50. Shade 80 may extend along the axis in a direction that projects away from crown 40 and collar 70 when configured in the extended orientation. As shown in FIG. 2, lantern 10 has an overall height "H" when configured in the extended orientation.

When the electrical input is provided to lighting device 20, lantern 10 in the extended orientation provides a light output 90. Light output 90 includes light output projecting from open end 84 of shade 80. When configured in the extended orientation, shade 80 at least partially encloses (e.g., surrounds, encapsulates, captures, etc.) a portion of the light output provided by lighting device 20. Light output 90 may thereby further include light output from lighting device 20 that interfaces with shade 80. By way of example, the light output from lighting device 20 may engage an inner surface of shade 80, pass through a central volume of shade 80, and emerge from an outer surface of shade 80 as diffused light, thereby defining a diffused portion of light output 90.

When configured in the extended orientation, shade 80 increases the surface area of the light source defined by lantern 10. Increasing the surface area of the light source reduces shadowing (e.g., relative to a point source, relative to a plurality of point sources, etc.). Shade 80 reduces shadowing because regions within a surrounding environment that may not receive light output from one area of shade 80 (e.g., due to the presence of an intermediate object, etc.) may receive a light output from another area of shade 80.

As shown in FIGS. 1-3, power cable 30 is wrapped around a portion of crown 40. In other embodiments, power cable 30 is wrapped around another portion of lantern 10 (e.g., collar 70, etc.). According to the exemplary embodiment shown in FIG. 3, end 32 of power cable 30 is exposed when shade 80 is configured in the extended orientation. The extended orientation may thereby facilitate disconnecting power cable 30 from lantern 10 (e.g., by disconnecting end 32 from an electrical input of lantern 10, etc.).

As shown in FIGS. 8-14, lantern 10 is configured in a storage orientation (e.g., compact orientation, folded orientation, etc.). A user may selectively reconfigure lantern 10 into the storage orientation to provide broad flood lighting to a surrounding area. In one embodiment, the storage orientation of lantern 10 is defined based on the orientation of shade 80. By way of example, lantern 10 may be configured in the storage orientation when shade 80 is configured in a storage orientation. According to the exemplary embodiment shown in FIGS. 8-14, shade 80 extends toward crown 40 when configured in the storage orientation. By way of example, shade 80 may extend along an axis that is orthogonal to a plane defined by plate 50. Shade 80 may extend along the axis in a direction that projects along collar 70 and toward crown 40 when configured in the storage orientation.

In one embodiment, shade 80 at least partially encloses (e.g., covers, contains, surrounds, encapsulates, captures, etc.) collar 70 and a portion of crown 40 when configured in the storage orientation. In the storage orientation, lantern 10 may include an internal space defined by at least an underside of crown 40, a surface of collar 70, and an inner surface of shade 80. According to the exemplary embodiment shown in FIGS. 1-14, a portion of power cable 30 is stored within the internal space and thereby protected by shade 80. Shade 80 may thereby cover and/or contain power cable 30 when configured in the storage orientation (e.g., when "turned up" into the storage orientation, etc.). The internal space may additionally or alternatively provide storage for various other cables, other components associated with lantern 10 (e.g., adapter ends for power cable 30, etc.), or still other items.

Figure 9:
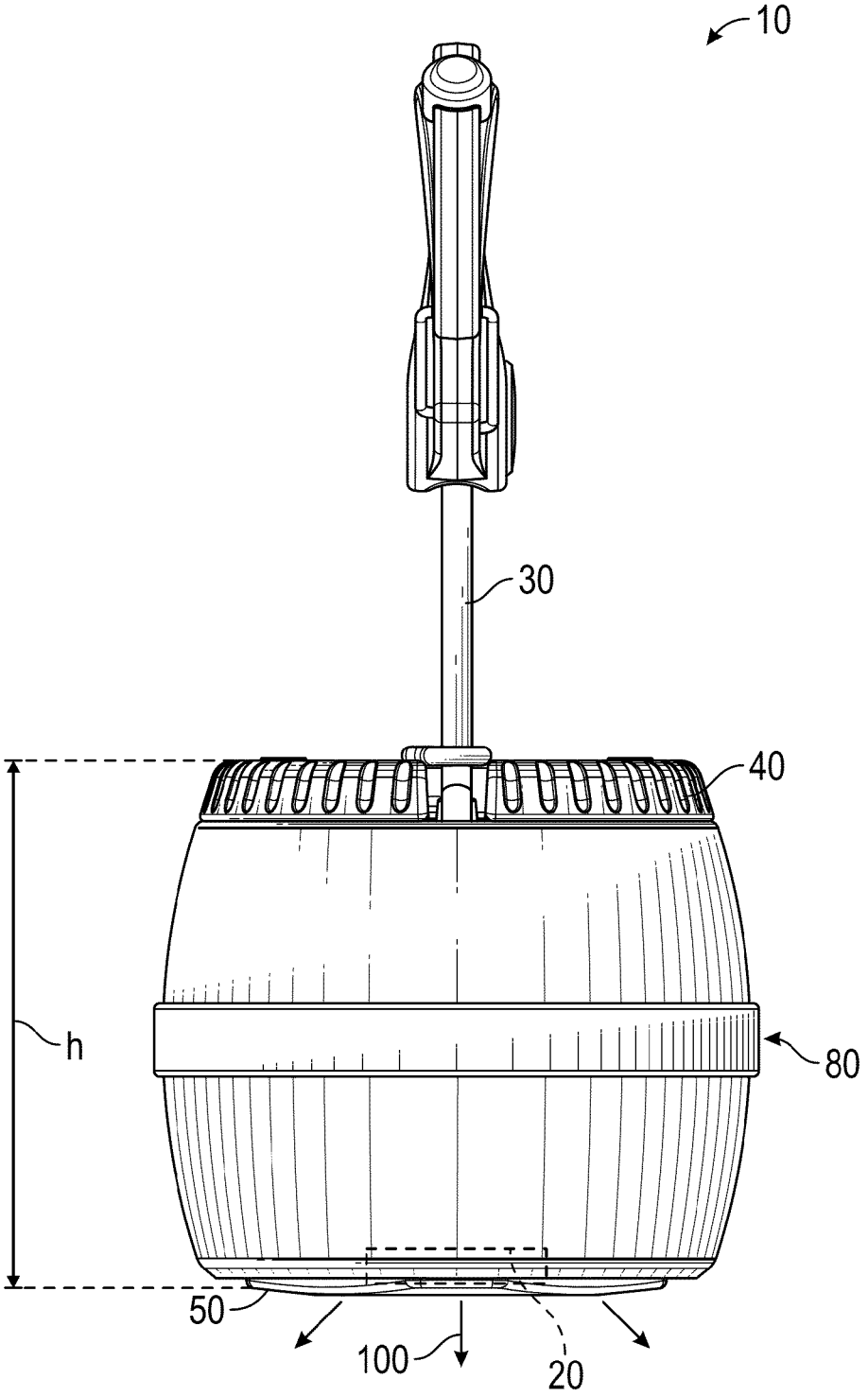
FIG. 9 is a front plan view of the lighting device of FIG. 8.

As shown in FIG. 9, lantern 10 has an overall height "h" when configured in the storage orientation. In the storage orientation, the overall height h of lantern 10 is reduced relative to the overall height H of lantern 10 when configured in the extended orientation. Lantern 10 may thereby be more compact when configured in the storage orientation. When configured in the storage orientation, a user may pack, store, or transport lantern 10 more easily. Such a reduction in height or size of lantern 10 may be particularly important for users backpacking with lantern 10. In one embodiment, a user may pack, store, or transport multiple lanterns 10 in the space traditionally required to pack, store, or transport one traditional portable lighting device (e.g., a portable lighting device having a fixed shade, a portable lighting device that is not selectively reconfigurable into a storage orientation, etc.).

When the electrical input is provided to lighting device 20, lantern 10 in the storage orientation provides a light output 100. When configured in the storage orientation, shade 80 does not enclose a portion of the light output provided by lighting device 20. Light output 100 thereby does not include light diffused by shade 80.

When configured in the storage orientation, shade 80 decreases the surface area of the light source defined by lantern 10. Decreasing the surface area of the light source may provide light output 100 having a greater intensity than light output 90 provided by lantern 10 when configured in the extended orientation. Light may be absorbed by shade 80 when lantern 10 is configured in the extended orientation. Orienting lantern 10 in the storage orientation eliminates such absorption, thereby increasing the light energy associated with light output 100 relative to the light energy associated with light output 90.

As shown in FIGS. 15-18, plate 50 includes a base portion, shown as ring 52, and a plurality of interface members, shown as blades 54, coupled to a projection, shown as projection 56. According to an exemplary embodiment, projection 56 forms a hollow cup having a sidewall extending from ring 52. The projection 56 may have a disk coupled to an end of the sidewall that opposes ring 52. The disk of projection 56 may be coupled to blades 54. In one embodiment, projection 56 defines a cavity that receives lighting device 20. In other embodiments, projection 56 does not define a hollow cup (i.e., projection 56 may be solid, etc.).

Figure 19:
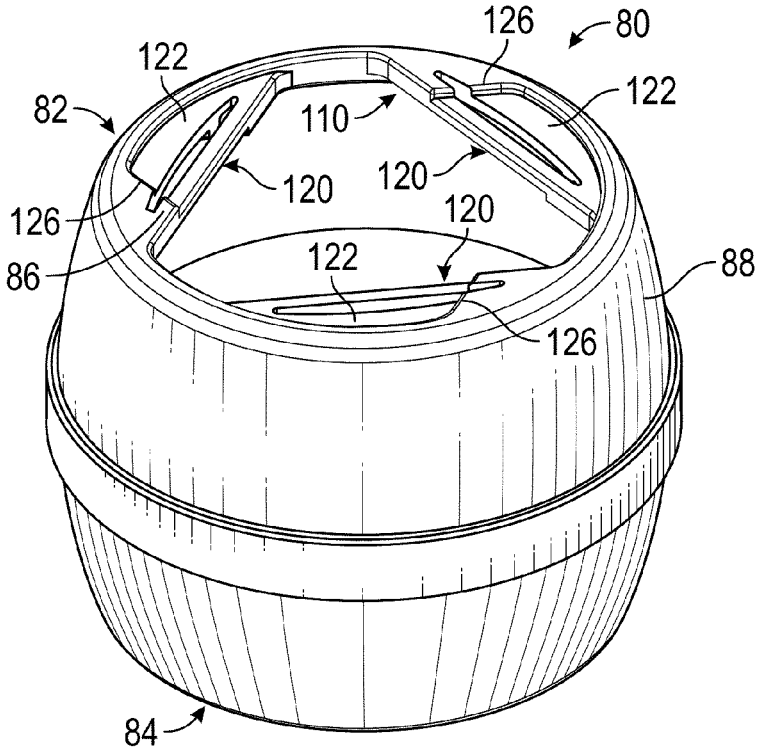
FIGS. 19-21 are perspective and plan views of a shade component of a lighting device, according to an exemplary embodiment.
Figure 20:
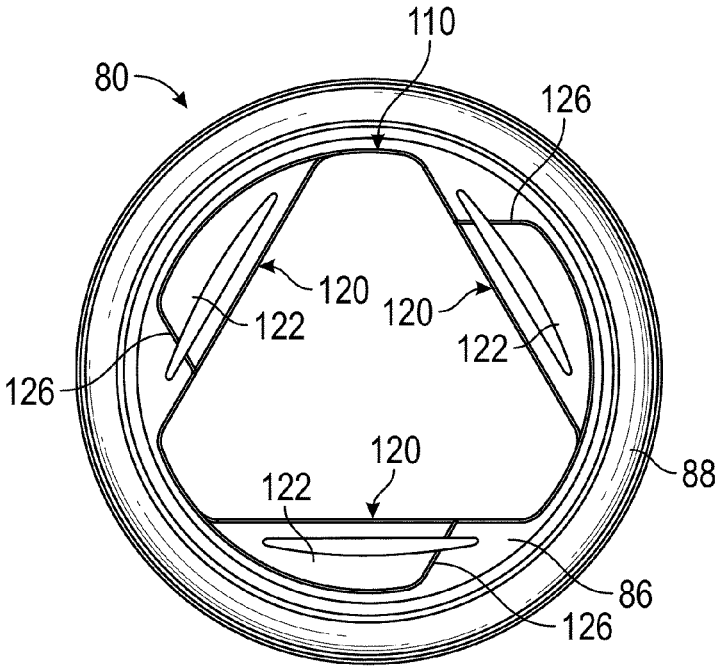
Figure 21:
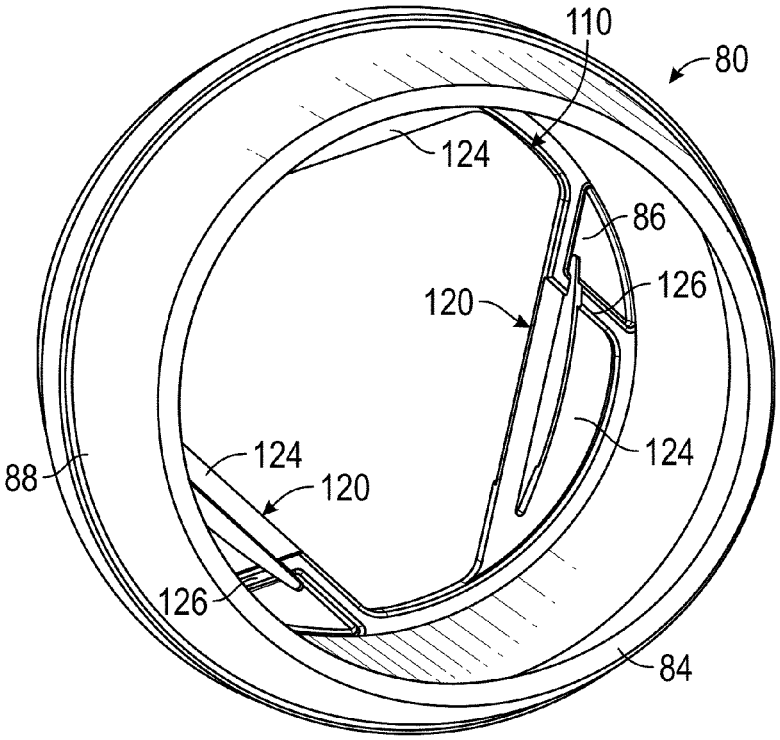

As shown in FIGS. 19-21, shade 80 includes a cap, shown as cap 86, coupled to a sidewall, shown as sidewall 88. Sidewall 88 is formed of a single unitary body, according to an exemplary embodiment. According to the alternative embodiment shown in FIGS. 19-21, sidewall 88 is formed of multiple subcomponents (e.g., an upper shade, a lower shade, and a shade belt, etc.) that are coupled together (e.g., adhesively secured, press fit, snap fit, welded, etc.). As shown in FIGS. 19-21, cap 86 is coupled to sidewall 88 at interface end 82 of shade 80.

Referring still to FIGS. 19-21, cap 86 defines an aperture, shown as blade receptacle 110. In one embodiment, blade receptacle 110 is shaped to receive blades 54 of plate 50. As shown in FIGS. 15-21, plate 50 has three blades 54 arranged in a generally triangular configuration. Blade receptacle 110 has a corresponding generally triangular shape, according to the exemplary embodiment shown in FIGS. 15-21. In other embodiments, plate 50 has more or fewer blades 54, or blades 54 are arranged in another configuration. Blade receptacle 110 may be shaped to receive such other configurations of blades 54.

Referring still to FIGS. 19-21, cap 86 of shade 80 defines a plurality of interfaces, shown as interfaces 120. According to an exemplary embodiment, blades 54 and interfaces 120 cooperate to define a twist-lock connection that secures shade 80 to plate 50. As shown in FIGS. 19-21, interfaces 120 each define a first surface 122 and an opposing second surface 124. In one embodiment, opposing second surfaces 124 are separated from first surfaces 122 by body portions of interfaces 120. The body portions of interfaces 120 may have thicknesses that are less than the thickness of cap 86. According to an exemplary embodiment, blades 54 engage opposing second surfaces 124 when lantern 10 is configured in the extended orientation. Blades 54 may engage first surfaces 122 when lantern 10 is configured in the storage orientation.

In one embodiment, a user may selectively configure lantern 10 into the extended orientation by inserting blades 54 and projection 56 into blade receptacle 110. The user may thereafter rotate shade 80 relative to plate 50 (and/or plate 50 relative to shade 80) until blades 54 reach the fully-locked position shown in FIG. 22. In the fully-locked position, blades 54 engage stops of interfaces 120, shown as stops 126. Stops 126 are positioned to limit the amount of relative rotation between blades 54 and shade 80 to a desired amount, according to an exemplary embodiment.

Figure 22:
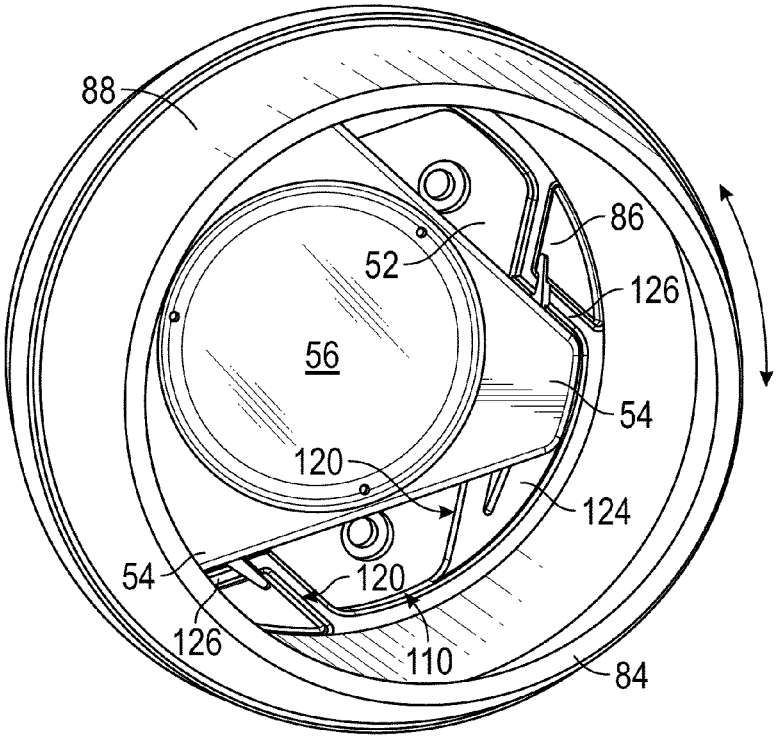
FIG. 22 is a perspective view of a plate component coupled to a shade component of a lighting device, according to an exemplary embodiment.
Figure 23:
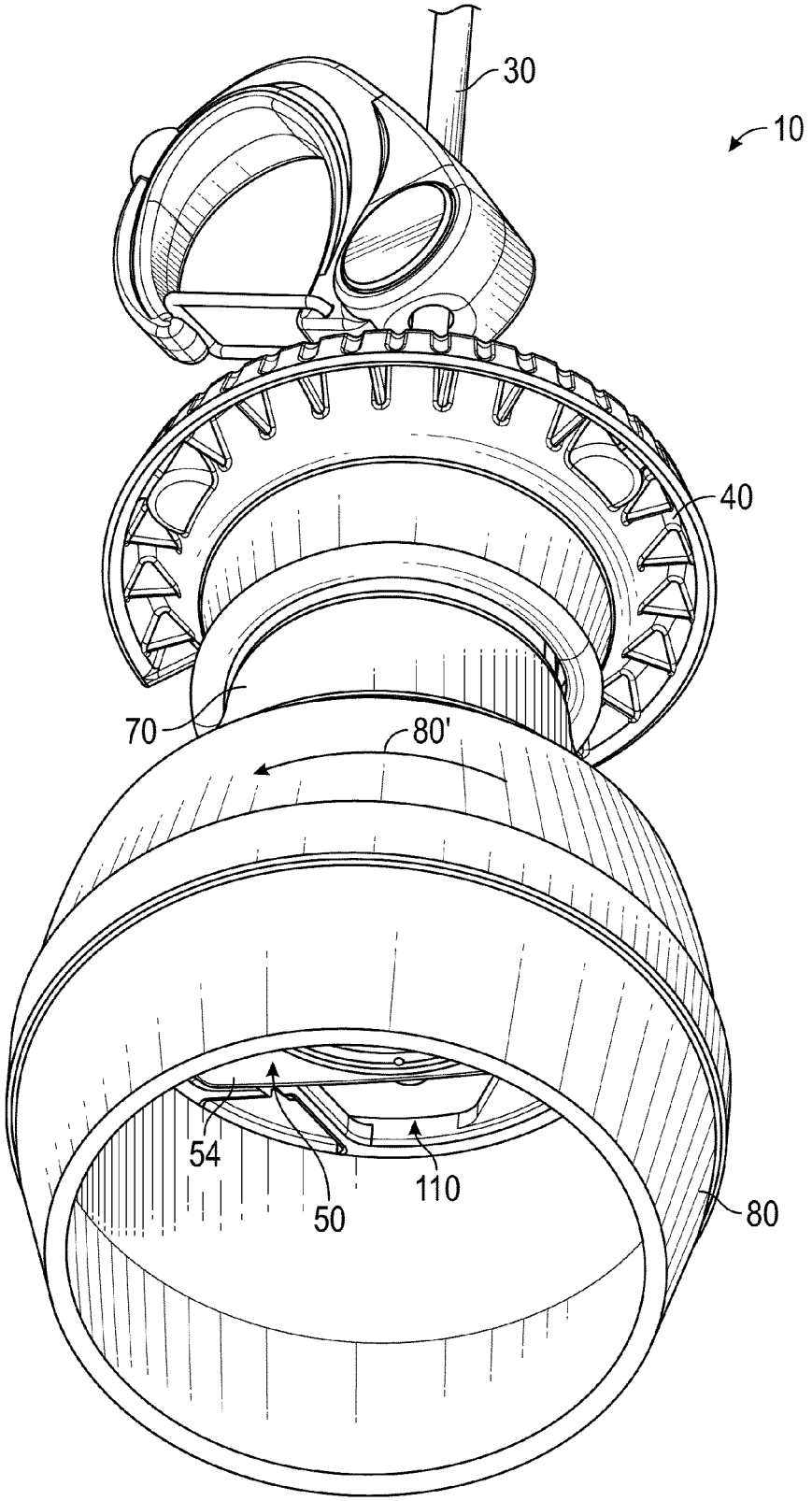
FIGS. 23-25 are perspective views showing a procedure for selectively reconfiguring the lighting device of FIG. 1 into a storage orientation from an extended orientation.

In the extended orientation shown in FIGS. 22-23, blades 54 engage opposing second surfaces 124 of interfaces 120 to secure shade 80. From the position shown in FIGS. 22-23, a user may selectively reconfigure lantern 10 into the storage orientation. By way of example, a user may secure plate 50 (e.g., by holding crown 40 and/or collar 70 with one hand, etc.) and rotate shade 80 relative to plate 50. As shown in FIG. 23, the user may rotate shade 80 along direction 80' (e.g., counterclockwise when viewed from below lantern 10, etc.) relative to plate 50 until blades 54 are generally aligned with blade receptacle 110 of shade 80. The user may thereafter remove shade 80 from plate 50 such that lantern 10 is configured in the orientation shown in FIG. 24. The user may, in addition to or in place of at least a portion of such movements, secure shade 80 (e.g., by holding it with one hand, etc.) and rotate plate 50 relative to shade 80 and/or withdraw blades 54 from blade receptacle 110.

Figure 24:
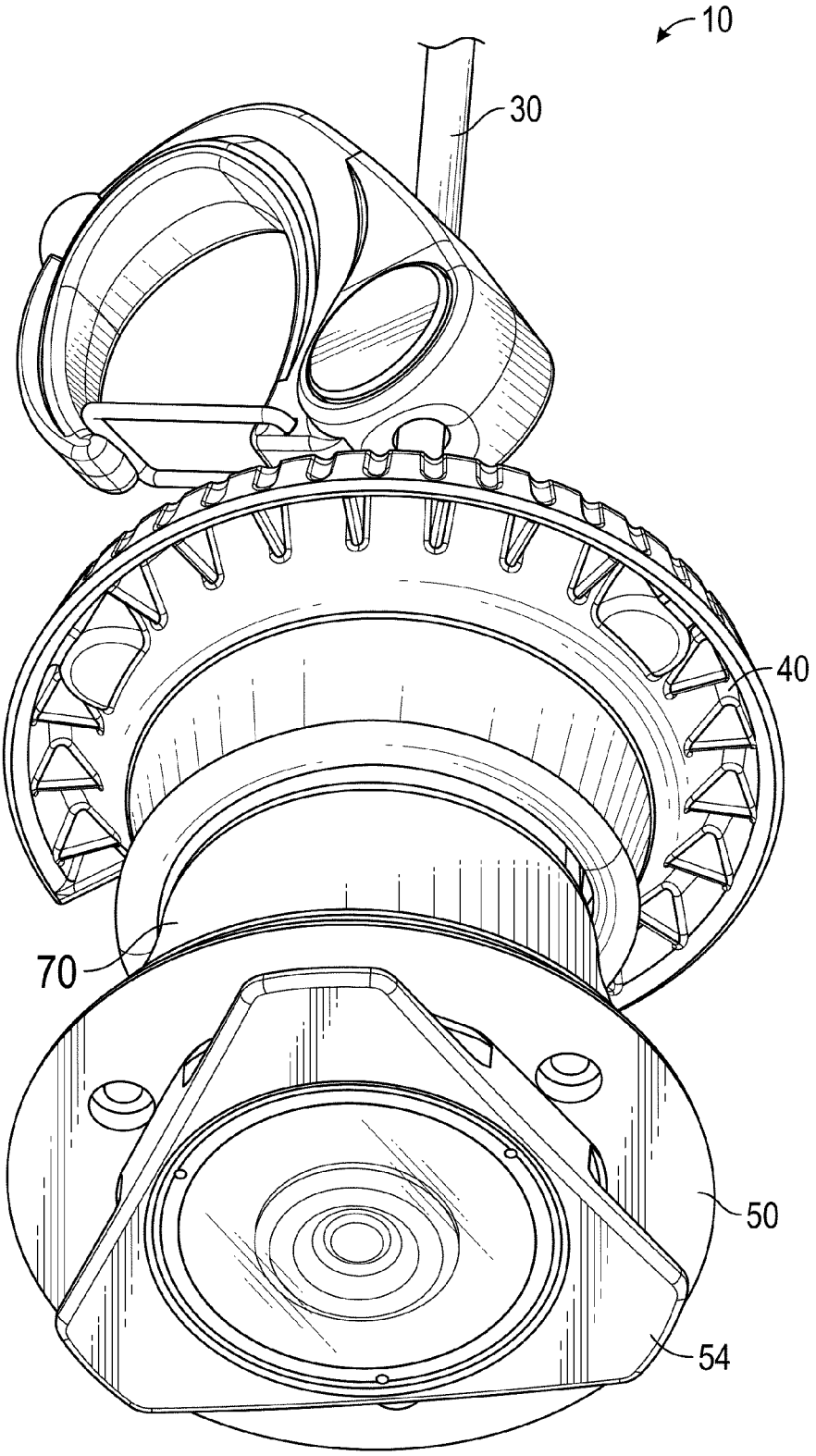
Figure 25:
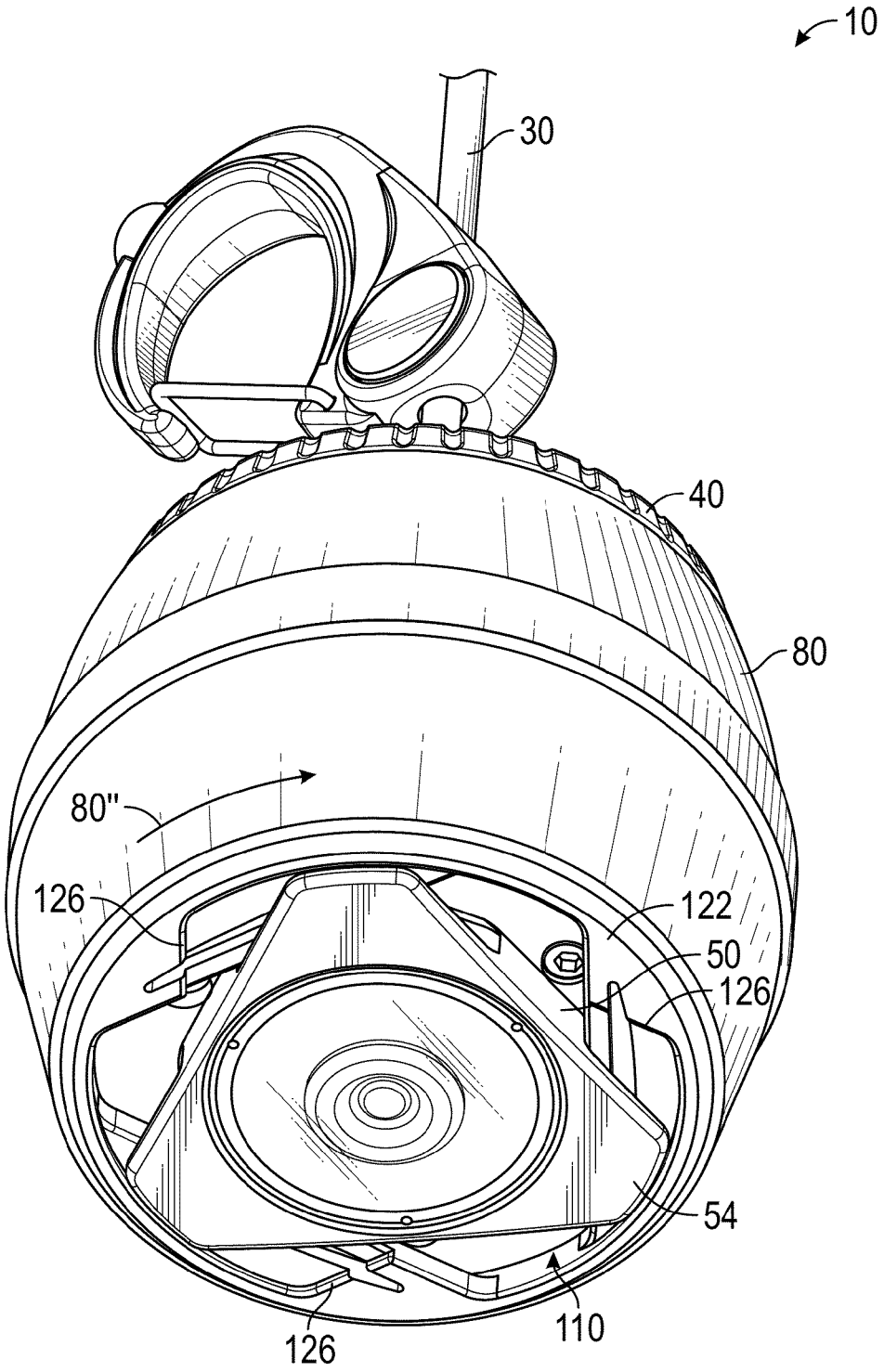

The user may thereafter rotate (e.g., reverse, flip, turn end-for-end, etc.) shade 80 while maintaining the orientation of plate 50 shown in FIG. 24 and align blades 54 with blade receptacle 110 (e.g., by rotating at least one of crown 40, plate 50, and shade 80, etc.). Blades 54 may thereafter be inserted into blade receptacle 110 and/or shade 80 may be translated such that blade receptacle 110 receives blades 54 therethrough. The user may thereafter rotate shade 80 and plate 50 relative to one another to secure (e.g., retain, hold, etc.) shade 80. As shown in FIG. 25, the user may rotate shade 80 along direction 80" (e.g., clockwise when viewed from below lantern 10, etc.) relative to plate 50 until blades 54 contact stops 126. In the orientation shown in FIG. 25, blades 54 may engage first surfaces 122 of interfaces 120 to secure shade 80.

Figure 26:
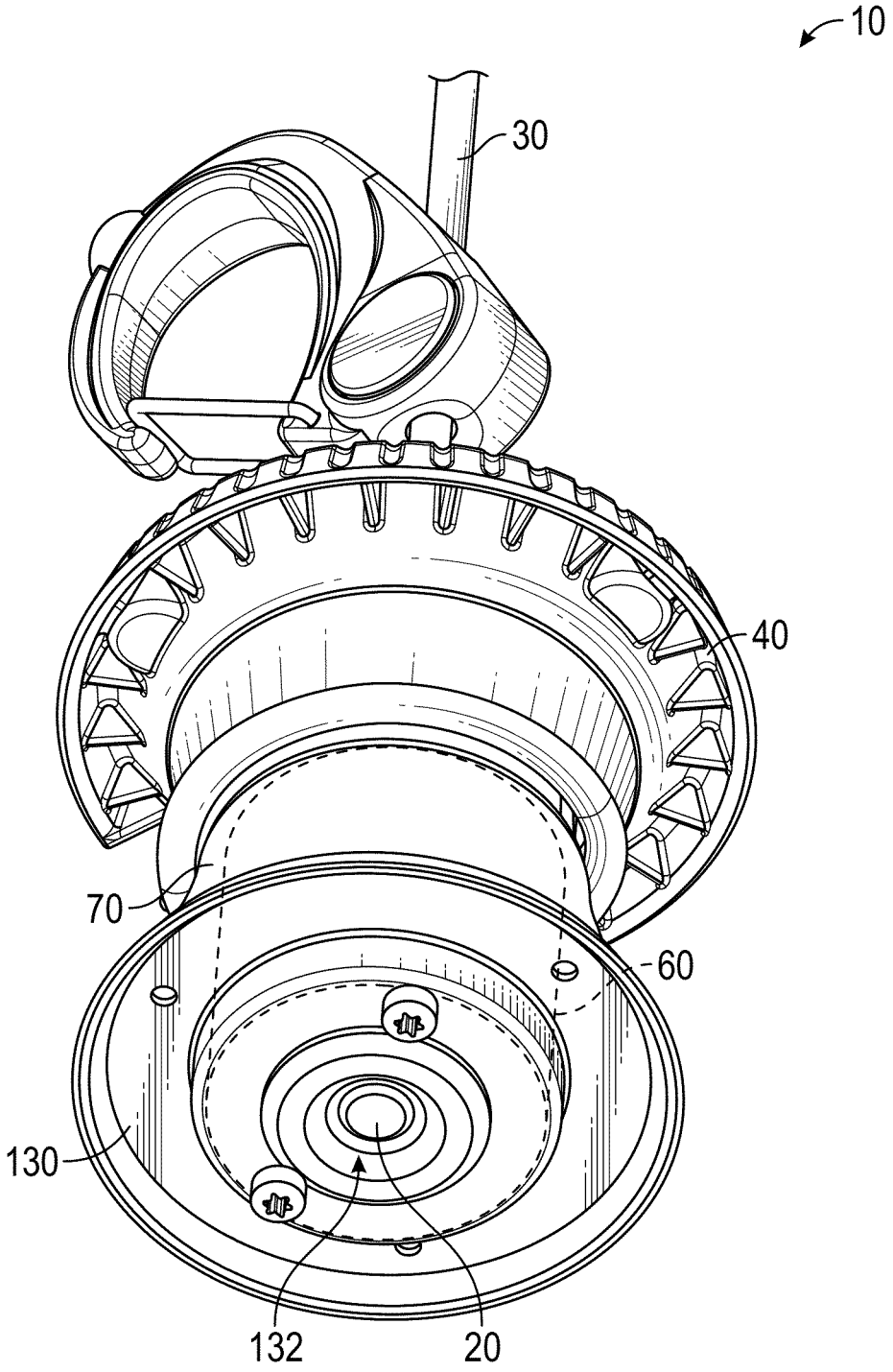
FIG. 26 is a perspective view of a lighting source of the lighting device of FIG. 1, according to an exemplary embodiment.

In one embodiment, FIG. 26 shows lantern 10 with shade 80 and plate 50 removed. By way of example, shade 80 may be removed as discussed above. According to the exemplary embodiment shown in FIG. 26, lantern 10 includes a plate, shown as LED plate 130. Plate 50 may be coupled to LED plate 130 with one or more removable fasteners. In other embodiments, plate 50 is otherwise coupled to LED plate 130 (e.g., adhesively secured, fixed to, integrally formed with, etc.). In one embodiment, FIG. 26 shows lantern 10 with plate 50 and the fasteners that selectively secure plate 50 to LED plate 130 removed. LED plate 130 may be coupled to internal structure 60 with a plurality of fasteners. In other embodiments, LED plate 130 is otherwise coupled to internal structure 60 (e.g., adhesively secured, fixed to, integrally formed with, etc.), coupled to collar 70, or still otherwise attached to the other components of lantern 10.

As shown in FIG. 26, LED plate 130 defines an aperture 132. In one embodiment, aperture 132 receives lighting device 20. As shown in FIG. 26, lighting device 20 includes a generally-circular protrusion extending from a backing. The generally-circular protrusion may provide a base, a part of which LEDs are provided. The backing may include one or more electrical terminals (e.g., electrodes, contacts, etc.) that are coupled to the LEDs. In other embodiments, lighting device 20 has still another physical arrangement of components. By way of example, lighting device 20 may include filament or other non-LED light sources, LEDs positioned in a tubular arrangement, still other components, or still other arrangements of similar components.

In one embodiment, lighting device 20 includes a high power LED emitter. By way of example, lighting device 20 may include a CXA1304 series LED emitter manufactured by Cree, Inc. (e.g., a model CXA1304-0000-000C00C20E5 LED emitter, etc.). Such a lighting device 20 may have a viewing angle of 115 degrees (e.g., forming a cone centered at a light axis of lighting device 20, etc.). In other embodiments, lighting device 20 has still another viewing angle.

Figure 6:
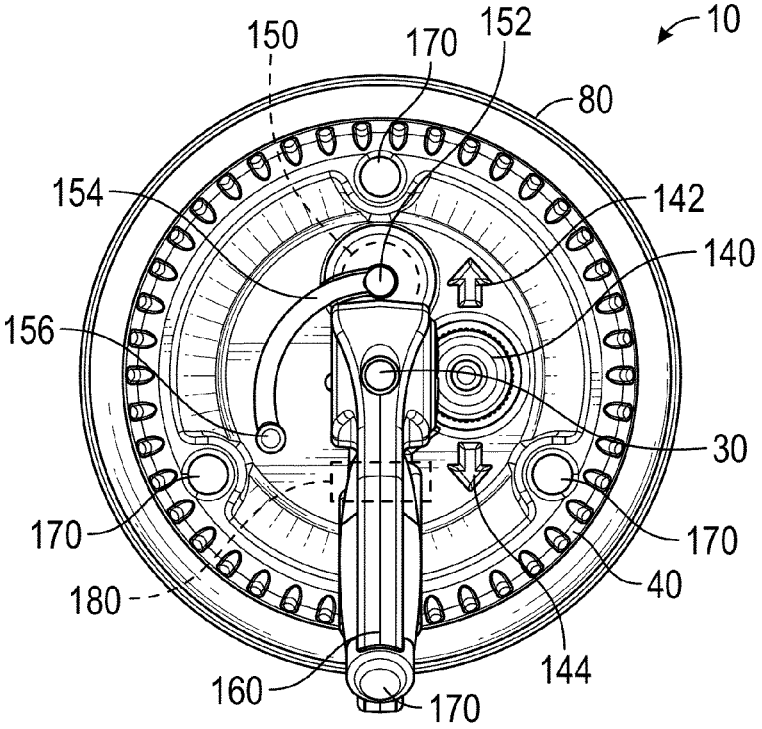
FIG. 6 is a top plan view of the lighting device of FIG. 1.
Figure 7:
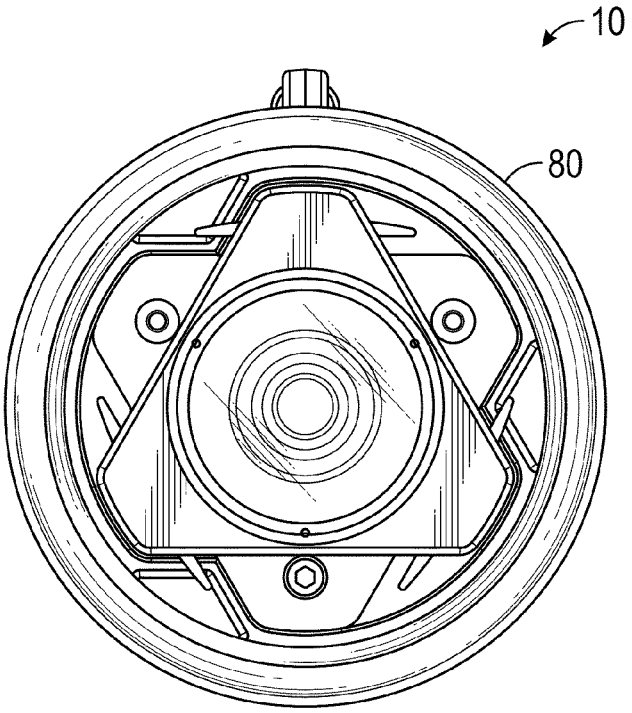
FIG. 7 is a bottom plan view of the lighting device of FIG. 1.
Figure 8:
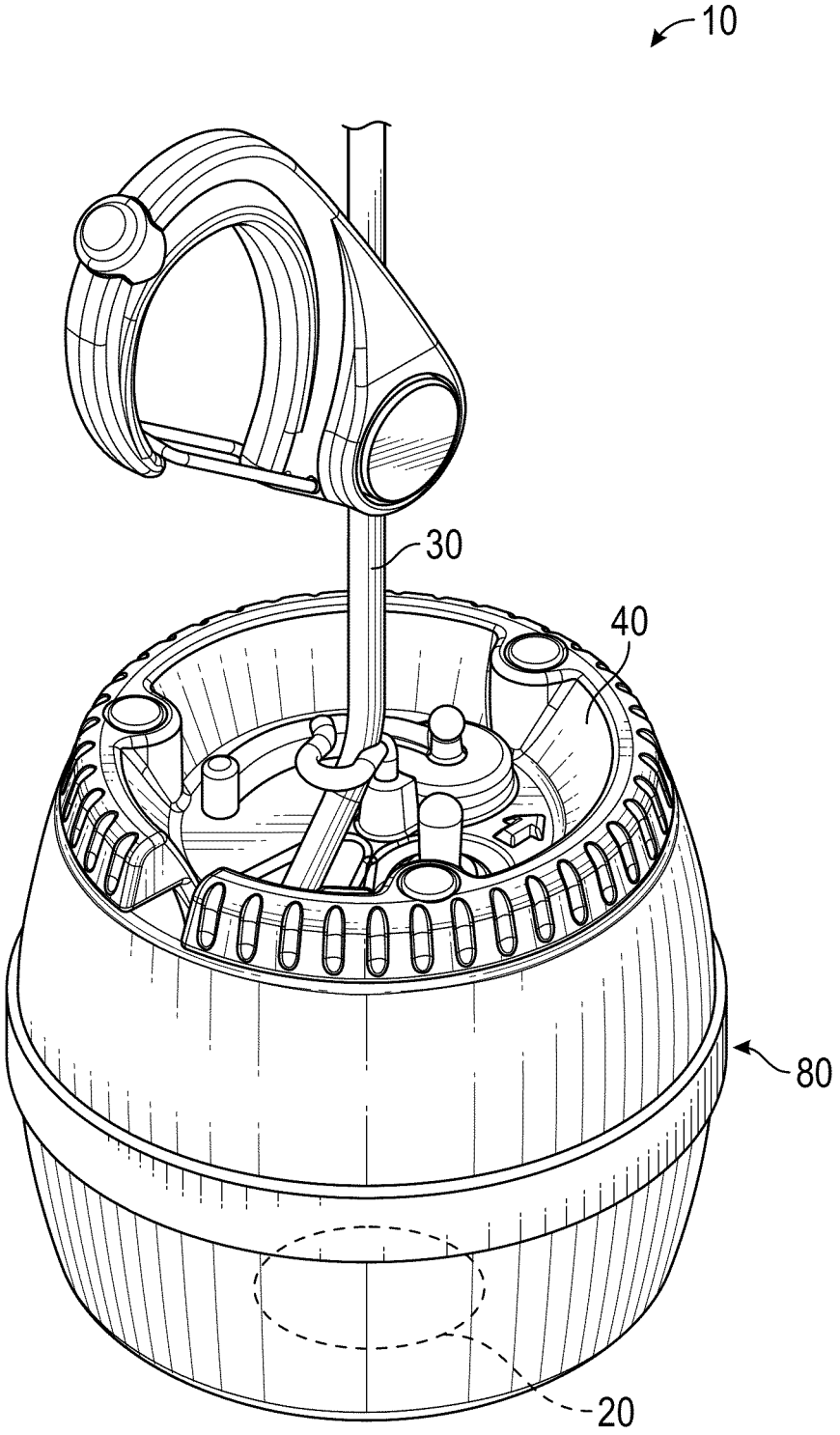
FIG. 8 is a front perspective view of the lighting device of FIG. 1 having the shade configured in a storage orientation, according to an exemplary embodiment.

In one embodiment, lantern 10 includes a user input device, shown in FIG. 6 as switch 140. In other embodiments, the user input device includes a touch interface, one or more buttons, or still other devices configured to receive a user input. Switch 140 may be protected (e.g., with a silicone or other flexible covering, etc.) to reduce the risk of damage thereto (e.g., from exposure to rain, other moisture, or debris, etc.). Lantern 10 is configured to provide a light output that varies based on a user input provided to the user input device, according to an exemplary embodiment. As shown in FIG. 6, lantern 10 is configured to provide a light output that varies based on the user input provided to switch 140. By way of example, lantern 10 may be configured to provide a light output that varies based on the position switch 140.

As shown in FIG. 6, switch 140 is a toggle switch. Switch 140 may be selectively actuatable between a first position, a second position, and a third position (e.g., the position shown in FIG. 6, etc.). As shown in FIG. 6, operational indicia, shown as arrow 142 and arrow 144, are provided to facilitate operation of switch 140 by a user. By way of example, arrow 142 may suggest actuation of switch 140 into the first position and arrow 144 may suggest actuation of switch 140 into the second position. Arrow 142 and arrow 144 are integrally formed as part of crown 40, according to the exemplary embodiment shown in FIG. 6. In other embodiments, arrow 142 and/or arrow 144 are separate components coupled to crown 40. While shown as arrow 142 and arrow 144, it should be understood that the operation indicia may include words, text, other symbols, or still other markings configured, positioned, shaped, or otherwise arranged to facilitate the use of lantern 10. In other embodiments, lantern 10 does not include such operational indicia.

Switch 140 is in electrical communication with lighting device 20. Switch 140 may also be in electrical communication with power cable 30. By way of example, switch 140 may be coupled in series between lighting device 20 and end 32 of power cable 30. With switch 140 in the first position, a first electrical input may be provided to lighting device 20. Lantern 10 may thereby produce a first light output with switch 140 in the first position. In one embodiment, the first light output defines a low level of lighting. With switch 140 in the second position, a second electrical input may be provided to lighting device 20. Lantern 10 may thereby produce a second light output with switch 140 in the second position. The second electrical input may be greater (e.g., greater current, greater voltage, etc.) than the first electrical input such that the second light output is greater (e.g., more intense, etc.) than the first light output. In one embodiment, the second light output defines a high level of lighting. With switch 140 in the third position, no electrical input may be provided to lighting device 20. Lantern 10 may thereby produce no light output with switch 140 in the third position. A user may thereby selectively engage switch 140 to reconfigure lantern 10 into various modes of light output (e.g., low mode, high mode, off mode, etc.).

Lantern 10 may provide the various modes of light output regardless of the position of shade 80 or orientation of lantern 10 (e.g., in the storage orientation, in the extended orientation, etc.). By way of example, a user may engage switch 140 to provide the first light output or the second light output when lantern 10 is in the storage orientation or shade 80 is removed from plate 50 (e.g., to provide multiple broad flood light profiles, etc.). By way of another example, a user may engage switch 140 to provide the first light output or the second light output when lantern 10 is in the extended orientation (e.g., to provide multiple diffused lighting profiles, etc.).

As shown in FIG. 6, lantern 10 includes an auxiliary power port, shown as chaining port 150. In one embodiment, chaining port 150 is in electrical communication with power cable 30. At least a portion of an electrical input provided to power cable 30 may thereby be available at chaining port 150. In one embodiment, chaining port 150 facilitates interconnecting multiple lanterns 10 to a single source of electrical power. By way of example, the power cable 30 of a first lantern 10 may be coupled to the source of electrical power, and the power cable 30 of a second lantern 10 may be coupled to the chaining port 150 of the first lantern 10. Chaining port 150 may be coupled to power cable 30 upstream of switch 140 such that power is supplied thereto regardless of the configuration of switch 140. Each interconnected lantern 10 may thereby be individually controllable (i.e., a user may turn on or off any one lantern 10 individually without turning on or off the remaining lanterns 10 that are chained together, etc.). Chaining port 150 may include one or more male electrical connectors and/or one or more female electrical connectors. By way of example, chaining port 150 may include a six millimeter female electrical connector.

According to the exemplary embodiment shown in FIG. 6, a removable cover 152 is disposed over chaining port 150. Removable cover 152 may provide a waterproof seal to reduce the risk of damage to chaining port 150 (e.g., from exposure to rain, other moisture, or debris, etc.). A user may remove removable cover 152 to utilize chaining port 150. As shown in FIG. 6, a first end of a cable, shown as tether 154, is coupled to removable cover 152. An opposing second end 156 of tether 154 is fixed to crown 40. Tether 154 may thereby prevent a user from misplacing removable cover 152.

According to an exemplary embodiment, the various electrical components of lantern 10 are coupled at least partially by a printed circuit board 180. In other embodiments, lantern 10 does not include a printed circuit board 180. Printed circuit board 180 may include a processing circuit configured to control the operation of lantern 10. By way of example, a user may provide an input to the processing circuit via the user input device, and the processing circuit may provide electrical signals to control the light output of lighting device 20 based on the user input.

As shown in FIG. 1, crown 40 includes a slot (e.g., aperture, depression, indentation, notch, etc.), shown as slot 42. In one embodiment, slot 42 provides a passageway that receives power cable 30. According to the exemplary embodiment shown in FIG. 1, power cable 30 extends from an upper side 44 of crown 40, through slot 42, and downward to an opposing underside 46 of crown 40. As shown in FIGS. 1-4, power cable 30 wraps around crown 40 along opposing underside 46 thereof and extends from slot 42 to end 32. In one embodiment, crown 40 is fixed to collar 70. In other embodiments, crown 40 is movable relative to the other components of lantern 10 (e.g., collar 70, etc.). Crown 40 may be rotated, thereby changing the angular distance between slot 42 and end 32 of power cable 30. Such movement of slot 42 may thereby take up or pay out power cable 30 from around crown 40 (e.g., to decrease or increase the length of power cable 30 that extends above crown 40, to decrease or increase, even if only slightly, a usable length or an excess length of power cable 30, etc.).

In one embodiment, power cable 30 is configured to suspend lantern 10. By way of example, power cable 30 may be configured to support the weight of lantern 10. As shown in FIG. 1, crown 40 includes a retainer, shown as hook 48. Hook 48 engages power cable 30 and holds lantern 10 upright, according to an exemplary embodiment. By way of example, hook 48 may prevent the weight of lantern 10 from pulling power cable 30 out of slot 42. Without hook 48, such movement may occur, which may cause lantern 10 to tip and/or power cable 30 to unwind from crown 40.

As shown in FIG. 2, lantern 10 includes an engagement device (e.g., a carabiner, etc.), shown as clip 160. In one embodiment, clip 160 engages power cable 30 and supports lantern 10 in a suspended position. An exemplary clip 160 and the operation thereof is disclosed in U.S. Pat. No. 8,434,894, titled "Lighting Apparatus; Components Thereof and Assemblies Incorporating the Same," which claims the benefit under 35 U.S.C. §120 of U.S. Provisional Patent. App. No. 61/261,656, titled "Lighting Apparatus; Components Thereof and Assemblies Incorporating the Same," both of which are hereby incorporated by reference in their entireties. As shown in FIG. 2, clip 160 includes a coupling device, shown as magnet 170. A user may suspend lantern 10 by clip 160 upon engaging magnet 170 with a metallic support, according to an exemplary embodiment. As shown in FIG. 6, a plurality of magnets 170 is coupled to crown 40. In one embodiment, a user may fix the position of lantern 10 upon engaging magnets 170 with a metallic support. In other embodiments, lantern 10 includes still other types of coupling devices (e.g., suction cups, etc.).

The foregoing description of embodiments of the disclosure have been presented for purposes of illustration and description. It is not intended to be exhaustive or to limit the disclosure to the precise form disclosed, and modifications and variations are possible in light of the above teachings or may be acquired from practice of the disclosure. The embodiments were chosen and described in order to explain the principals of the disclosure and its practical application to enable one skilled in the art to utilize the disclosure in various embodiments and with various modifications as are suited to the particular use contemplated.

As utilized herein, the terms "approximately", "about", "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like, as used herein, mean the joining of two members directly or indirectly to one another. Such joining may be stationary (e.g., permanent) or moveable (e.g., removable, releasable, etc.). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the figures. It should be noted that the orientation of various elements may differ according to other exemplary embodiments, and that such variations are intended to be encompassed by the present disclosure.

It is important to note that the construction and arrangement of the elements of the systems and methods as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. It should be noted that the elements and/or assemblies of the components described herein may be constructed from any of a wide variety of materials that provide sufficient strength or durability, in any of a wide variety of colors, textures, and combinations. Accordingly, all such modifications are intended to be included within the scope of the present inventions. Other substitutions, modifications, changes, and omissions may be made in the design, operating conditions, and arrangement of the preferred and other exemplary embodiments without departing from scope of the present disclosure or from the spirit of the appended claims.

Embodiments of the disclosure may be described in the general context of method steps, which may be implemented in one embodiment by a program product including machine-executable instructions, such as program code, for example, in the form of program modules executed by machines in networked environments. Generally, program modules include routines, programs, objects, components, data structures, etc., that perform particular tasks or implement particular abstract data types. Machine-executable instructions, associated data structures, and program modules represent examples of program code for executing steps of the methods disclosed herein. The particular sequence of such executable instructions or associated data structures represent examples of corresponding acts for implementing the functions described in such steps.

An exemplary system for implementing the overall system or portions of the disclosure might include a general purpose computing device in the form of a computer, including a processing unit, a system memory, and a system bus that couples various system components including the system memory to the processing unit. The system memory may include read only memory (ROM) and random access memory (RAM). The computer may also include a magnetic hard disk drive for reading from and writing to a magnetic hard disk, a magnetic disk drive for reading from or writing to a removable magnetic disk, and an optical disk drive for reading from or writing to a removable optical disk such as a CD ROM or other optical media. The drives and their associated machine-readable media provide nonvolatile storage of machine-executable instructions, data structures, program modules, and other data for the computer.

What is claimed is:

1. A lighting device, comprising:

a body portion;

a collar having a first end coupled to the body portion;

a plate coupled to a second end of the collar;

a light source disposed at the second end of the collar, wherein the light source includes one or more LEDs; and a shade including a sidewall and a cap, the cap defining a plurality of interfaces, the plurality of interfaces and the plate cooperating to releasably secure the shade in a storage orientation and an extended orientation.

2. The lighting device of claim 1, wherein the shade extends towards the body portion along an axis that is orthogonal to a plane defined by the plate when arranged in the storage orientation and extends away from the body portion along the axis that is orthogonal to the plane defined by the plate when arranged in the extended orientation such that an overall height of the lighting device increases when the shade is arranged in the extended orientation.

3. The lighting device of claim 2, wherein the light source is configured to provide a light output when the shade is arranged in at least one of the storage orientation and the extended orientation.

4. The lighting device of claim 3, wherein the shade at least partially encloses the light source when arranged in the extended orientation such that the sidewall of the shade diffuses at least a portion of the light output of the light source, thereby increasing an illumination area of the light source.

5. The lighting device of claim 4, wherein the light source is configured to provide the light output over a focused area when the shade is arranged in the storage orientation.

6. The lighting device of claim 4, wherein the shade at least partially encloses the collar and the body portion when arranged in the storage orientation such that an internal space is defined by at least an underside of the body portion, a surface of the collar, and an inner surface of the sidewall of the shade.

7. The lighting device of claim 6, further comprising a cable coupled to the body portion and configured to provide an electrical input to power the light source, wherein at least a portion of the cable is selectively wrappable around at least one of the body portion and the surface of the collar such that the cable is storable within the internal space.

8. The lighting device of claim 7, wherein the body portion defines a slot positioned to provide a passageway through which the cable extends to exit the internal space.

9. The lighting device of claim 8, wherein the body portion includes a hook positioned to engage the cable after the cable extends through the slot, the hook configured to prevent inadvertent extension and retraction of the cable.

10. The lighting device of claim 1, wherein each of the plurality of interfaces have a first surface and an opposing second surface.

11. The lighting device of claim 10, wherein the plate includes a base portion, a projection, and a plurality of blades coupled to the projection, the projection spacing the plurality of blades a distance from the base portion, wherein the plurality of blades extend through an aperture defined by the cap to interface with the first surfaces when the shade is arranged in the storage orientation and interface with the opposing second surfaces when the shade is arranged in the extended orientation.

12. The lighting device of claim 11, wherein the plurality of blades and the plurality of interfaces releasably secure the shade to the plate with a twist-lock connection, and wherein at least one of the first surfaces and the opposing second surfaces include a stop positioned to limit relative rotation between the plate and the shade.

13. A lighting device, comprising:

a body portion;

a plate coupled to the body portion and having a plurality of interface members;

a collar disposed between the body portion and the plate;

a light source extending through at least a portion of the plate, the light source configured to provide a light output; and a cover including a sidewall and a cap, the cap defining a plurality of interfaces and an aperture shaped to receive the plurality of interface members of the plate, the plurality of interfaces and the plurality of interface members cooperating to releasably secure the cover to the plate in a storage orientation and an extended orientation;

wherein the cover at least partially encloses the light source when arranged in the extended orientation such that the sidewall of the cover diffuses at least a portion of the light output of the light source.

14. The lighting device of claim 13, wherein the plurality of interfaces each have a first surface and an opposing second surface.

15. The lighting device of claim 14, wherein the plurality of interface members engage the first surfaces when the cover is arranged in the storage orientation and the plurality of interface members engage the opposing second surfaces when the cover is arranged in the extended orientation.

16. The lighting device of claim 15, wherein the plurality of interfaces and the plurality of interface members releasably secure the cover to the plate with a twist-lock connection.

17. The lighting device of claim 16, wherein at least one of the first surfaces and the opposing second surfaces include a stop positioned to limit relative rotation between the plate and the cover.

18. The lighting device of claim 13, wherein the light source is configured to provide the light output when the lighting device is arranged in both the storage orientation and the extended orientation.

19. The lighting device of claim 13, wherein the cover at least partially encloses the collar and the body portion when arranged in the storage orientation such that an internal space is defined by at least an underside of the body portion, a surface of the collar, and an inner surface of the sidewall of the cover.

20. A portable lighting device, comprising:

a body;

a collar having a peripheral wall, a first end of the peripheral wall coupled to the body;

a plate coupled to a second end of the peripheral wall of the collar;

a light source configured to provide a light output;

a cable configured to provide an electrical input to power the light source; and a shade configured to at least partially enclose the peripheral wall of the collar and an underside of the body such that an internal space is defined by at least the underside of the body, the peripheral wall of the collar, and an inner surface of the shade;

wherein at least a portion of the cable is selectively wrappable around at least one of the body and the peripheral wall of the collar such that the cable is storable within the internal space.

* * * * *